US011479931B2

(12) United States Patent
Wilson et al.

(10) Patent No.: US 11,479,931 B2
(45) Date of Patent: Oct. 25, 2022

(54) ELONGATE PANEL FOR A SOUND WALL AND A STIFFENER MEMBER FOR THE SAME

(71) Applicant: AIL INTERNATIONAL INC., Sackville (CA)

(72) Inventors: Michael W. Wilson, Sackville (CA); Wayne W. Ford, Moncton (CA)

(73) Assignee: AIL INTERNATIONAL INC., Sackville (CA)

( * ) Notice: Subject to any disclaimer, the term of this patent is extended or adjusted under 35 U.S.C. 154(b) by 0 days.

(21) Appl. No.: 16/640,681

(22) PCT Filed: Jan. 23, 2020

(86) PCT No.: PCT/CA2020/050078
§ 371 (c)(1),
(2) Date: Feb. 20, 2020

(87) PCT Pub. No.: WO2020/150826
PCT Pub. Date: Jul. 30, 2020

(65) Prior Publication Data

US 2021/0363712 A1 Nov. 25, 2021

Related U.S. Application Data

(60) Provisional application No. 62/795,902, filed on Jan. 23, 2019.

(51) Int. Cl.
*E01F 8/00* (2006.01)
*E04H 17/14* (2006.01)
(Continued)

(52) U.S. Cl.
CPC ..... *E01F 8/0011* (2013.01); *E01F 8/0023* (2013.01); *E01F 8/0064* (2013.01);
(Continued)

(58) Field of Classification Search
CPC ..... E04B 1/82; E04B 1/84; E04B 1/86; E01F 8/00; E01F 8/0011; E01F 8/0023;
(Continued)

(56) References Cited

U.S. PATENT DOCUMENTS 4,566,558 A 1/1986 Link, Jr. et al.
4,838,524 A 6/1989 McKeown et al.
(Continued)

FOREIGN PATENT DOCUMENTS

CA 2146110 C 2/1998
CA 2148877 C 10/1998
(Continued)

OTHER PUBLICATIONS

WIPO, International Search Report and Written Opinion of International Application No. PCT/CA2020/050079 dated Apr. 8, 2020.
(Continued)

*Primary Examiner* — Edgardo San Martin
(74) *Attorney, Agent, or Firm* — Norton Rose Fulbright Canada LLP

(57) ABSTRACT

A stiffener member for a hollow elongate panel. The hollow elongate panel may include a first end wall having a groove formation formed by a pair of inner walls and extending a length of the hollow elongate panel. The groove formation may extend into the hollow elongate panel. The stiffener member may include a bight member having opposing ends; a pair of arm members respectively extending from one of the opposing ends of the bight member to provide a substantially U-shaped configuration; and a flange member extending from each of the pair of arm members. The flange member may extend inwardly to abut one of the pair of inner walls of the groove formation when the stiffener member is received within the hollow elongate panel.

25 Claims, 26 Drawing Sheets

(51) Int. Cl.

| | |
|---|---|
| ***E04B 1/82*** | (2006.01) |
| ***E04C 3/07*** | (2006.01) |
| *E04H 17/00* | (2006.01) |
| *E04H 17/22* | (2006.01) |

(52) U.S. Cl.
CPC ..... *E04C 3/07* (2013.01); *E04H 17/1456* (2021.01); *E01F 8/007* (2013.01); *E04H 17/22* (2013.01)

(58) Field of Classification Search
CPC ..... E01F 8/0064; E01F 8/007; E01F 8/023; E04H 17/00; E04H 17/14; E04H 17/1456; E04H 17/1452; E04H 17/1413; E04H 17/1486; E04C 3/07
See application file for complete search history.

(56) References Cited

U.S. PATENT DOCUMENTS

| | | | | |
|---|---|---|---|---|
| 5,217,771 | A | 6/1993 | Schmanski et al. | |
| 5,272,284 | A | 12/1993 | Schmanski | |
| 5,572,847 | A | 11/1996 | Elmore et al. | |
| 6,085,485 | A * | 7/2000 | Murdock | E04C 2/36 52/794.1 |
| 6,408,594 | B1 * | 6/2002 | Porter | E04B 7/22 52/270 |
| 7,104,720 | B2 | 9/2006 | Humphries et al. | |
| 7,343,715 | B2 | 3/2008 | Ito et al. | |
| 7,478,797 | B2 * | 1/2009 | Laws | E04H 17/168 52/316 |
| 7,546,900 | B2 | 6/2009 | Humphries et al. | |
| 7,658,042 | B2 * | 2/2010 | Hiel | E04B 1/94 52/762 |
| 8,561,360 | B2 * | 10/2013 | Corbin, Jr. | E01F 8/0023 52/144 |
| 8,561,371 | B2 * | 10/2013 | Sanders | E04B 1/14 52/764 |
| 8,955,281 | B2 | 2/2015 | Pietruczynik et al. | |
| 9,091,069 | B2 * | 7/2015 | Marandos | B29C 39/08 |
| 10,221,529 | B1 * | 3/2019 | Sanders | E01F 8/0011 |
| 11,199,001 | B2 * | 12/2021 | Vogler | E04H 1/1205 |
| 11,352,787 | B2 * | 6/2022 | Amend | E04B 2/8605 |
| 2005/0265780 | A1 | 12/2005 | Humphries et al. | |
| 2006/0118354 | A1 | 6/2006 | Corbin, Jr. et al. | |
| 2007/0131480 | A1 | 6/2007 | Corbin, Jr. et al. | |
| 2007/0277476 | A1 | 12/2007 | Macleod et al. | |
| 2010/0243369 | A1 * | 9/2010 | Fusiek | E01F 8/007 181/210 |
| 2013/0180799 | A1 | 7/2013 | Tizzoni | |
| 2021/0395964 | A1 * | 12/2021 | Wilson | E01F 8/0011 |

FOREIGN PATENT DOCUMENTS

| | | | | |
|---|---|---|---|---|
| CN | 205421057 | U | 8/2016 | |
| CN | 106381819 | A | 2/2017 | |
| CN | 206376197 | U | 8/2017 | |
| CN | 107724265 | A | 2/2018 | |
| CN | 208309568 | U | 1/2019 | |
| EP | 0589346 | A1 | 3/1994 | |
| EP | 1279771 | A2 | 1/2003 | |
| EP | 1840270 | A1 | 10/2007 | |
| FR | 2690000 | A1 * | 10/1993 | E01F 8/007 |
| GB | 1536546 | A | 12/1978 | |
| JP | 2003041527 | A | 2/2003 | |
| KR | 200206725 | Y1 | 12/2000 | |
| KR | 200425367 | Y1 * | 9/2006 | E01F 8/00 |
| KR | 20100007898 | U | 8/2010 | |
| KR | 20110128622 | A | 11/2011 | |
| KR | 101359395 | B1 | 2/2014 | |
| KR | 101849171 | B1 | 4/2018 | |
| NL | 8702073 | A | 4/1987 | |

OTHER PUBLICATIONS

WIPO, International Search Report and Written Opinion of International Application No. PCT/CA2020/050078 dated Apr. 15, 2020.
durisol.com—MASH TL-4 Crash Tested Noise Barrier Product Guide, May 2021, retrieved from https://www.durisol.com/wp-content/uploads/2021/05/MASH-TL-4-Product-Guide-EN-DRAFT2-002.pdf.
Government of the Hong Kong Special Administrative Region, Environmental Protection Department, "Guidelines on Design of Noise Barriers", https://www.epd.gov.hk/epd/english/environmentinhk/noise/guide_ref/design_barriers_content2.html, dated Feb. 27, 2003.

* cited by examiner

ELONGATE PANEL FOR A SOUND WALL AND A STIFFENER MEMBER FOR THE SAME

CROSS REFERENCE TO RELATED APPLICATIONS

This application claims priority from U.S. provisional patent application No. 62/795,902, filed on Jan. 23, 2019, the entire contents of which are hereby incorporated by reference herein.

FIELD

Embodiments of the present application generally relate to the field of sound walls, and in particular to elongate panels for sound walls and stiffener members for the elongate panels.

BACKGROUND

High traffic through fares, such as highways, railroads and the like, produce significant noise. In urban centers, buildings such as housing developments and businesses are often built proximate to the through fares and as a result, require protection from noise and require privacy. To provide the desired noise protection and privacy, sound walls or barriers (sometimes referred to as anti-noise or acoustic walls or barriers) may be erected along stretches of through fares, primarily in urban centers, to deflect and/or dampen sound resulting from vehicular traffic and to provide privacy.

Canadian Patent No. 2,146,110 discloses a sound barrier including a wall having a series of adjacent elongate boards joined with overlapping sealed joints. The first and last boards in the series define first and second generally parallel side edges respectively. The series of boards further defines a lower edge extending between the first and second side edges. At least one rail is attached to the wall and extends between the first and second side edges. A skirt extends between the first and second side edges and below the lower edge. First and second generally parallel posts are mounted below the ground in concrete footings. The first post has a lengthwise groove which is adapted to receive the first edge of the wall, and the second post has a lengthwise groove which is adapted to receive the second edge of the wall. The panels are constructed from boards, upper rails, middle rails, lower rails, and a skirt. The boards are formed of wood, particle board, wafer board, plastic, and the like.

Canadian Patent No. 2,148,877 discloses an elongated outdoor acoustic barrier for erection along a roadway or the periphery of an airport, for reflecting and absorbing sounds emanating from the roadway or airport. The acoustic barrier includes a plurality of substantially vertical columns arrayed at spaced intervals along the length of the acoustic barrier with the lower ends of the vertical columns anchored in large cylindrical concrete caissons. Each vertical column has a recessed groove extending along its exposed above-ground lateral surface facing an adjacent spaced column. A plurality of elongated flat rectangular panels is arranged in a vertical edgewise array. Opposite ends of each panel are securely received in the recessed grooves of a pair of adjacent columns. At least one of the panels is an extruded prestressed hollow core concrete panel.

U.S. Pat. No. 5,272,284 discloses a sound wall for placement along a roadside for reducing the transmission of sound from a traffic area. The sound wall comprises a plurality of stiff, resilient containment members respectfully configured with a channel configuration and having an enclosed channel volume and continuous open side. Each channel volume is filled with a composite composition of rubber chips and binder compressed within the channel and substantially filling the channel volume. The containment members are stacked in nesting relationship to form a wall structure, with the open side being oriented toward the traffic area.

U.S. Patent Application Publication No. 2007/0131480 discloses a sound barrier that comprises a plurality of elongate sound arresting members arranged end to end and stacked vertically, one upon another, to form a barrier wall. The sound arresting members are disposed generally between a plurality of spaced vertical support members and may be secured thereto by a plurality of elongate transition connectors coupled to each support members. The elongate transition connectors have distal ends that extend in directions toward oppositely disposed support members and are received within apertures formed in respective ends of the sound arresting members at their respective ends. Alternatively, the sound arresting members may be coupled to the spaced vertical supports without transition connectors.

Sound walls that avoid the use of concrete footings have been considered. For example, U.S. Patent Application Publication No. 2013/0180799 discloses a supporting structure for an anti-noise barrier. The supporting structure is in the form of an S-shaped sheet pile. The sheet pile has a first part and a second part of such a length that, in use, the second part of the sheet pile is insertable into the ground to form the supporting structure foundation, while the first part of the sheet pile emerges from the ground upwards. The first part of the sheet pile is provided with connection means through which sound-absorbent panels can be connected.

While sound walls of the types described above have been found to provide adequate noise protection and privacy, the costs associated with constructing these sound walls can be significant. In situations where the upright vertical posts or columns are embedded in concrete footings, increased costs both in terms of time and money result. As will be appreciated, concrete footings must cure before the sound wall panels can be installed. Also, the concrete footings must be mixed and casted on site increasing the number of construction vehicles required during construction. Embedding the vertical posts or columns in the concrete footings may often be a large expense of sound wall construction. Decreasing the number of concrete footings that are required by increasing the lateral spacing between adjacent vertical posts or columns may be desired. Doing this however, can have negative impacts on the structural integrity of the sound walls.

Improvements in sound walls that reduce construction costs yet maintain structural integrity may be desirable.

SUMMARY

It should be appreciated that this Summary is provided to introduce a selection of concepts in a simplified form that are further described below in the Detailed Description. This Summary is not intended to be used to limit the scope of the claimed subject matter.

In one aspect, the present application may provided a stiffener member for a hollow elongate panel. The hollow elongate panel may include a first end wall having a groove formation formed by a pair of inner walls and extending a length of the hollow elongate panel. The groove formation may extend into the hollow elongate panel. The stiffener member may include: a bight member having opposing ends; a pair of arm members respectively extending from one of the opposing ends of the bight member to provide a substantially U-shaped configuration; and a flange member extending from each of the pair of arm members, the flange member extending inwardly to abut one of the pair of inner walls of the groove formation when the stiffener member is received within the hollow elongate panel.

In some embodiments, the flange member extends substantially orthogonally from a distal end of the respective arm members to abut one of the pair of inner walls of the groove formation.

In some embodiments, the bight member, the pair of arm members, and the flange members are a unitary component.

In some embodiments, the respective arm members include one or more elongate slots aligned with one or more fastener slots of each of a front wall and a rear wall of the elongate panel.

In some embodiments, the pair of arm members are configured to respectively abut one of a front wall or a rear wall of the hollow elongate panel.

In some embodiments, the flange member is configured to abut a portion of the first end wall.

In some embodiments, the bight member is configured to abut a portion of a top wall of the elongate panel.

In some embodiments, the stiffener member extends substantially the length of the hollow elongate panel.

In some embodiments, the stiffener member is constructed with cold formed steel.

In some embodiments, an angle between the flange member and a corresponding arm member is an acute angle.

In some embodiments, an angle between the flange member and a corresponding arm member is an obtuse angle.

In another aspect, the present application may provide a stiffener member for a hollow elongate panel. The hollow elongate panel including a bottom wall having a groove formation formed by a pair of inner walls and extending a length of the hollow elongate panel. The groove formation may extend into the hollow elongate panel. The stiffener member may include: a substantially U-shaped member having a first end and a second end; and a flange member extending from at least one of the first end or the second end. The flange member may extend inwardly to abut one of the pair of inner walls of the groove formation when the stiffener member is received within the hollow elongate panel.

In some embodiments, the flange member extends substantially orthogonally from the first end to abut one of the pair of inner walls of the groove formation.

In some embodiments, the flange member is configured to abut a portion of the first end wall.

In another aspect, the present application may provide panel including: a hollow elongate panel. The hollow elongate panel may include: a first end wall; a first side wall and second side wall respectively extending from one of opposing sides of the first end wall; and a second end wall joining the first side wall and the second side wall. The second end wall may include a groove formation extending into the hollow elongate panel and extending a length of the hollow elongate panel. The panel may include a stiffener member received within the hollow elongate panel. The stiffener member may include a bight member having opposing ends; a pair of arm members respectively extending from one of the opposing ends of the bight member to provide a substantially U-shaped configuration; and a flange member extending from each of the pair of arm members, the flange member extending inwardly to abut one of the pair of inner walls of the groove formation.

In some embodiments, the flange member extends substantially orthogonally from a distal end of the respective arm members to abut one of the pair of inner walls of the groove formation.

In some embodiments, the bight member, the pair of arm members, and the flange members are a unitary component.

In some embodiments, the pair of arm members are configured to respectively abut one of the first side wall or the second side wall of the hollow elongate panel.

In some embodiments, the flange member is configured to abut a portion of the first end wall.

In some embodiments, the first end wall of the hollow elongate panel includes a tongue formation configured to be received within a groove formation of an adjacent panel, wherein the tongue formation extends away from the first end wall, wherein the groove formation extends into the hollow elongate panel, and wherein the bight member is a substantially planar member configured to abut a portion of the top wall.

In some embodiments, the stiffener member extends substantially the length of the hollow elongate panel.

In some embodiments, the stiffener member is constructed of cold formed steel.

In some embodiments, the respective arm members include one or more elongate slots aligned with one or more fastener slots of each of the first side wall and the second side wall of the elongate panel.

In some embodiments, the stiffener member extends substantially the length of the hollow elongate panel.

In some embodiments, the stiffener member is constructed with cold formed steel.

BRIEF DESCRIPTION OF DRAWINGS

Embodiments will now be described more fully with reference to the accompanying drawings in which.

DETAILED DESCRIPTION

Figure 1:
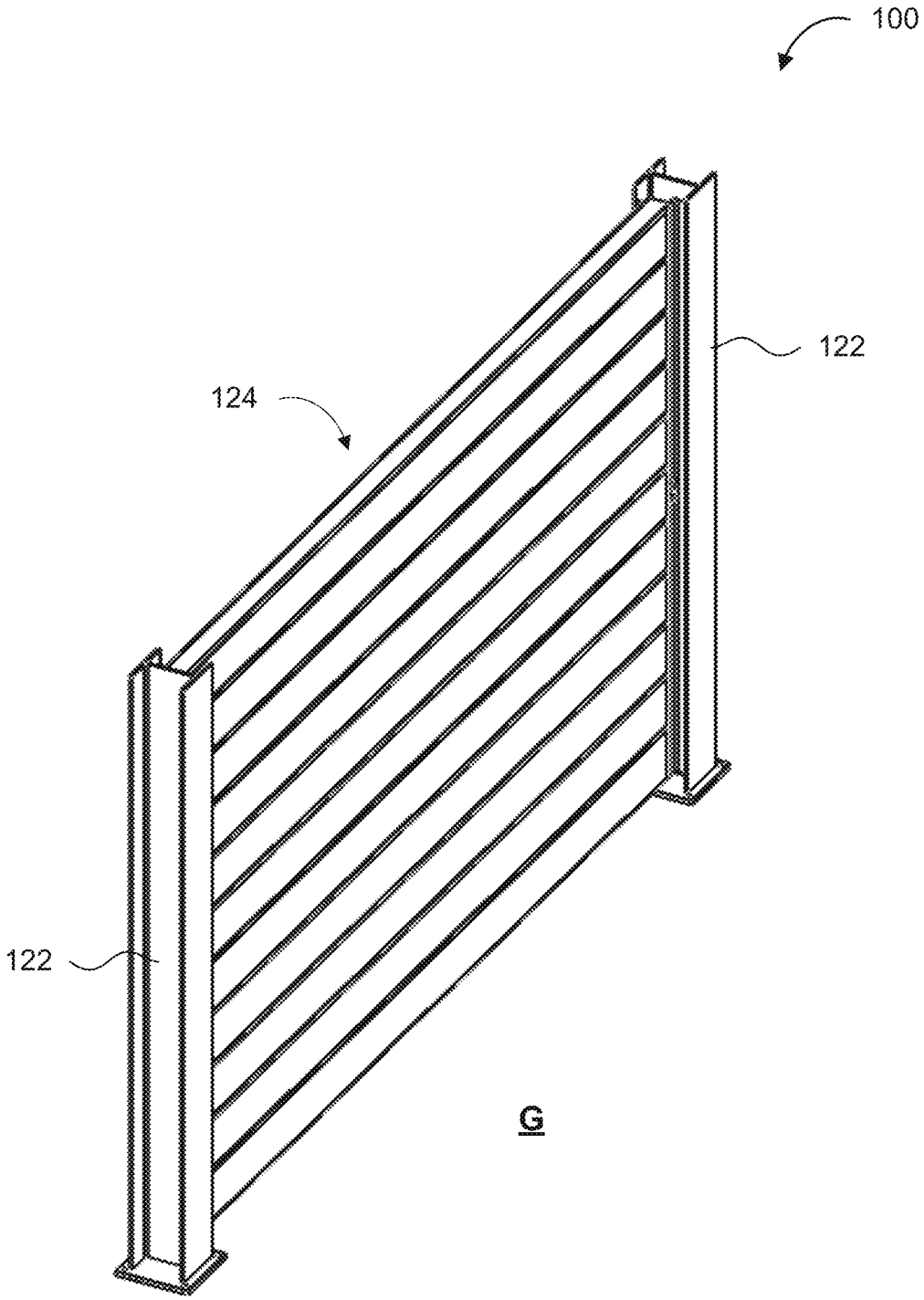
FIG. 1 is a perspective view of a sound wall.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "affixed" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly affixed" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and/or implementation of the subject matter according to the subject disclosure. Thus, the phrases "an example," "another example," and similar language throughout the subject disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to."

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of a lower-numbered item (e.g., a "first" item) and/or a higher-numbered item (e.g., a "third" item).

As used herein, the terms "approximately", "about", "substantially", and "generally" represent an amount close to the stated amount or a deviation from a strict definition that still results in the desired function or result being performed or achieved. For example, the terms "approximately", "about", "substantially", and "generally" may refer to an amount or a deviation that is within engineering tolerances that would be readily appreciated by a person skilled in the art.

In the present application, various embodiments of a sound wall are described with reference to the figures. The sound wall includes a pair of laterally spaced posts. The laterally spaced posts may be generally vertical posts relative to a foundation ground or grade G. A plurality of elongate panels may extend between the posts, and the elongate panels may be stacked vertically one on top of another. At least one of the plurality of elongate panels may include an elongate stiffener member therein. For example, a top elongate panel and a bottom elongate panel in the stack may respectively accommodate an elongate stiffener member therein.

In another example, one or more elongate panels positioned between the top elongate panel and the bottom elongate panel may include an elongate stiffener member therein. In some embodiments, the number of elongate panels within a plurality of elongate panels that are reinforced with stiffener members may be a function of at least one of: maximum expected wind load incident on the constructed sound wall or the distance between the laterally spaced posts (e.g., the length of the respective elongate panels). Other criteria for identifying the number of reinforced elongate panels may be contemplated.

Reference is made to FIG. 1, which illustrates a perspective view of a sound wall 100, in accordance with an embodiment of the present application. The sound wall 100 may be configured to deflect or dampen sound.

The sound wall 100 includes a pair of laterally spaced support posts 122 extending upwardly from an underlying earth formation (e.g., the ground G). The respective support posts 122 may be configured to be generally vertical relative to the underlying earth formation. The sound wall 100 includes a plurality of elongate panels 124 stacked one on top of another in a vertical direction. The plurality of elongate panels 124 extends between the laterally spaced posts 122.

In the present example, the elongate panels 124 can be hollow or tubular. In some examples, the elongate panels 124 may be formed of plastic material such as polyvinylchloride (PVC). Other materials for forming the elongate panels 124 may be contemplated.

For ease of exposition, FIG. 1 is illustrative of two laterally spaced, support posts 122 with elongate panels 124 extending there between. The sound wall 100 may span a larger distance and may include a series of laterally spaced support posts 122, and stacked elongate panels 124 extend between pairs of adjacent support posts 122.

Figure 2:
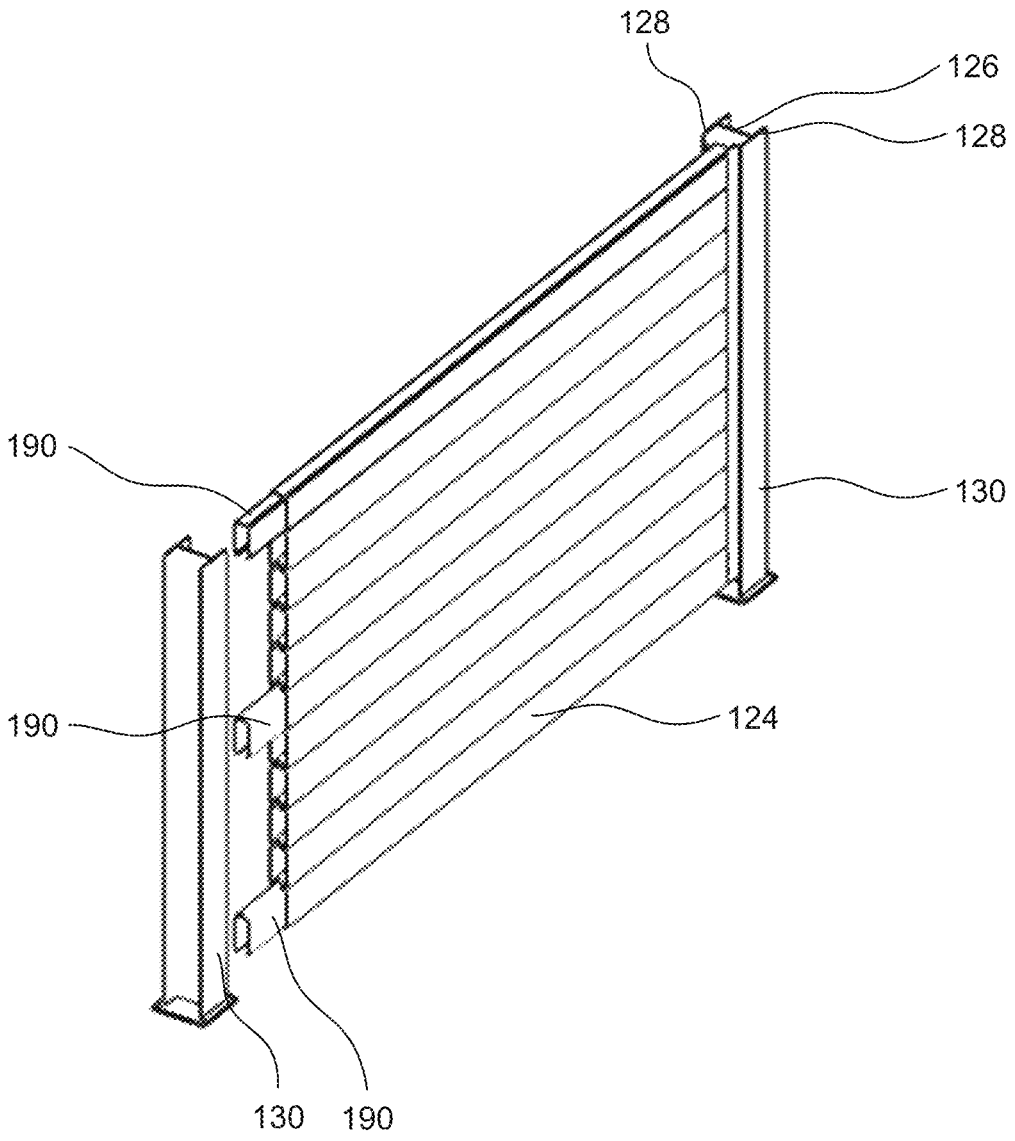
FIG. 2 is a partial exploded, perspective view of the sound wall of FIG. 1.

Reference is made to FIG. 2, which illustrates a partial exploded, perspective view of the sound wall 100 of FIG. 1. The respective support posts 122 include a central member 126. The central member 126 may have a member edge extending in an elongate direction of the respective support post 122. The support post 122 may include a flange 128 extending along the member edge and positioned substantially normal to the central member 126. In some examples, the respective support post 122 may include a pair of flanges 128. The pair of flanges 128 may be positioned on opposing member edges of the central member 126.

In some examples, the respective support posts 122 may be an elongate beam member in the form of an H-beam or an I-beam formed of steel or other suitable structural material. The flanges 128 may be generally at right angles to the central member 126 and present opposing and generally planar outer surfaces 130. For example, the flanges 128 may be generally at right angles to a web of the H/I-beam.

In some embodiments, the sound wall 100 may include an elongate stiffener member 190 positioned within at least one of the plurality of elongate panels 124. In the illustration of FIG. 2, the elongate stiffener member 190 may be positioned within several elongate panels of the stack of elongate panels, including a top elongate panel, a bottom elongate panel, and one or more intermediate elongate panels. Placing the elongate stiffener member 190 within one or more elongate panels 124 can structurally enhance the respective elongate panels 124 by reducing vertical deflection of the combined stack of elongate panels 124. In some scenarios, vertical deflection of the combined stack of elongate panels 124 may be caused in part by gravitational force on the weight of the stacked elongate panels 124. Vertical deflection of elongate panels may manifest as: (i) a central portion of a given elongate panel sagging or drooping towards the grade G; and (ii) end regions of the given elongate panel sitting at an elevation greater than the corresponding sagging or drooping central portion of the elongate panel.

Further, placing the elongate stiffener member 190 within one or more elongate panels 124 can structurally enhance the respective elongate panels 124 by reducing horizontal deflection of the combined stack of elongate panels 124. An example of horizontal deflection shown from a side view of elongate panels is illustrated, for example, at FIG. 25 of the present application.

In some examples, by extending at least a reinforced top elongate panel and a reinforced bottom elongate panel between laterally spaced support posts 122, the combination of the support posts 122 and the reinforced elongate panels can define a reinforced frame for confining the plurality of elongate panels 124.

For ease of exposition, the elongate stiffener members 190 are illustrated as protruding from the respective elongate panels 124 to illustrate positioning of the respective elongate stiffener members 190. However, when the sound wall is assembled, the elongate stiffener members 190 are received substantially within the respective elongate panels 124.

Figure 3:
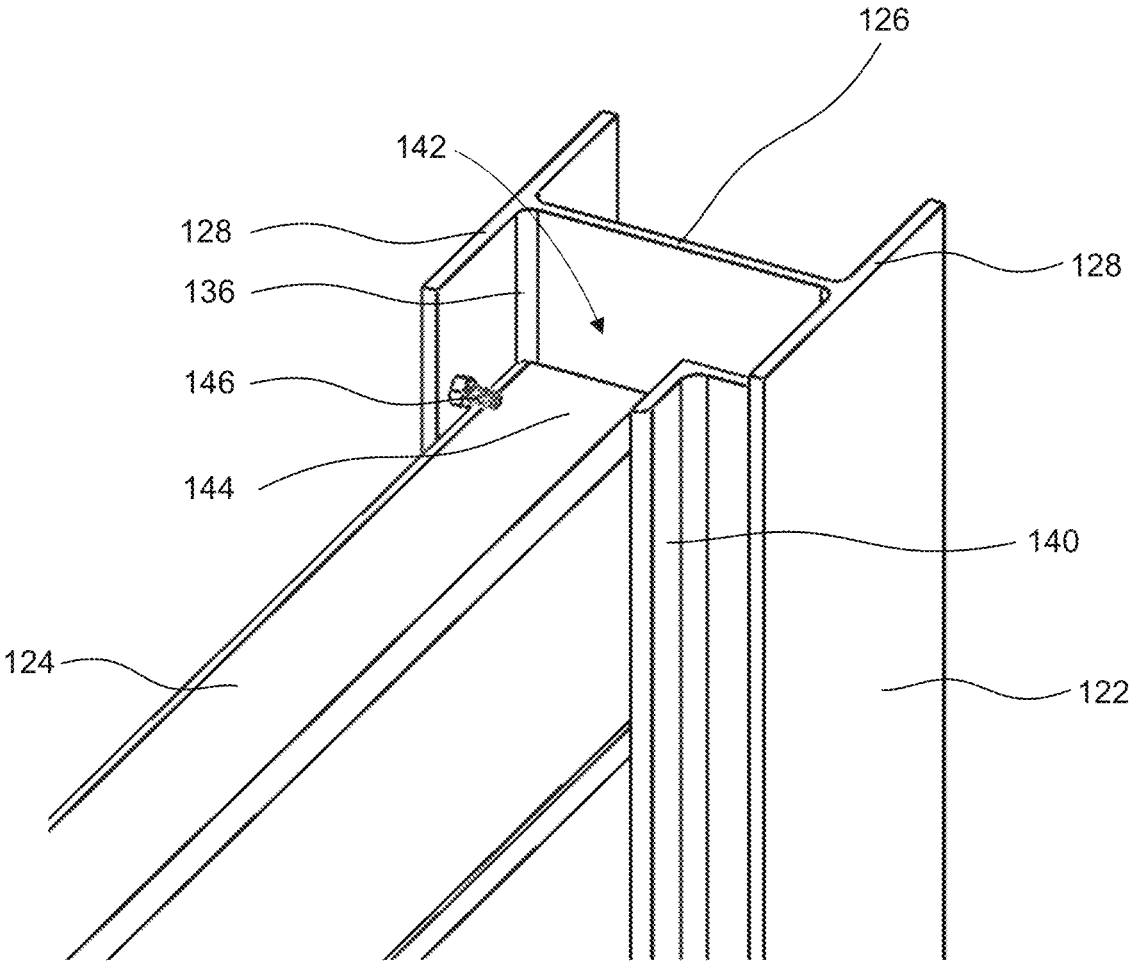
FIG. 3 is an enlarged perspective view of end regions of elongate panels of FIG. 1.

Reference is made to FIG. 3, which illustrates an enlarged perspective view of end regions of elongate panels 124 of FIG. 1. In FIG. 3, the support post 122 includes the central member 126 having a member edge 136. The support post 122 includes the flange 128 extending along the member edge 136. The flange 128 may be positioned substantially normal to the central member 126.

The support post 122 includes a fin 140 extending from the central member 126 to define a cavity 142. The cavity 142 may be circumscribed at least by a portion of the flange 128, the central member 126, and the fin 140. In some embodiments, the fin 140 may be welded to the central member 126. In some other embodiments, the central member 126 and the fin 140 may be a unitary component, and the fin 140 may extend substantially perpendicularly from the surface of the central member 126. End regions 144 of the respective elongate panels 124 may be retained between the flange 128 and the fin 140.

To minimize occurrences of one or more elongate panels 124 being displaced from the opening of the cavity 142, in some embodiments, the support post 122 may include an aperture positioned on the flange 128 and positioned proximal to an opening end of the cavity 142. The aperture may be configured to receive a retaining fastener 146. The retaining fastener 146 may be a removable screw, a dowel, or other protrusion for maintaining the top elongate panel and the series of elongate panels within the cavity 142.

Figure 4:
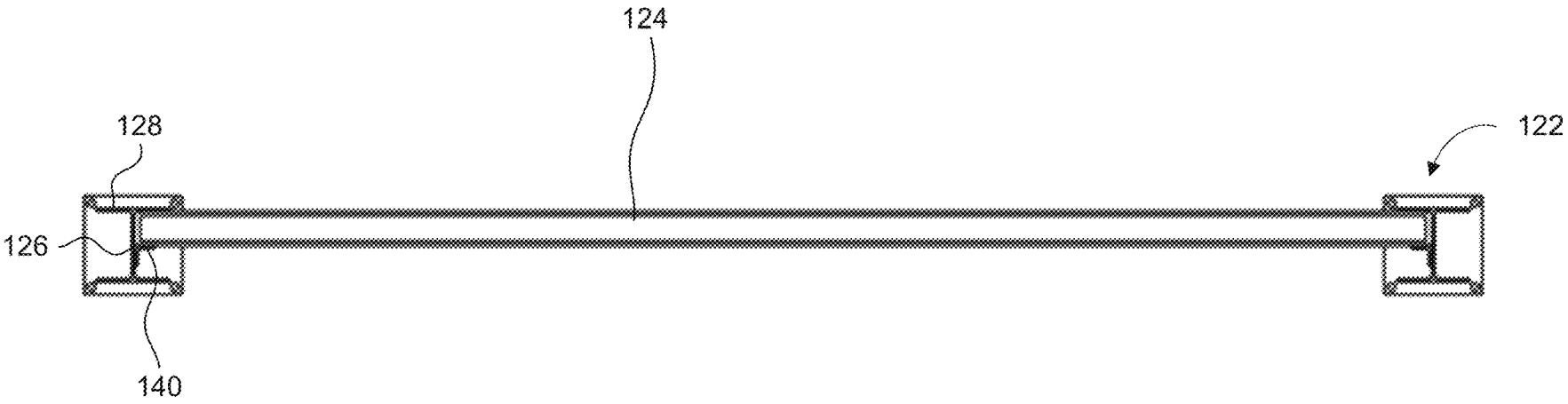
FIG. 4 illustrates a top view of elongate panels and two support posts of the sound wall of FIG. 1.

Reference is made to FIG. 4, which illustrates a top view of the support posts 122 and elongate panels 124 extending between the laterally spaced support posts 122 of FIG. 1.

The sound wall 100 may be installed based on a series of steps. Adjacent support posts 122 may be erected and configured to extend substantially perpendicular from the underlying earth formation. In FIG. 4, the support posts 122 may extend into/out of the illustrated page and a cavity 142 of the respective support posts 122 may extend into/out of the illustrated page. The respective cavities 142 may receive one or more elongate panels from a top portion of the respective support posts 122, and the one or more elongate panels may extend between the laterally spaced posts and stacked in a vertical direction (e.g., into/out of the page of FIG. 4).

In some examples, the respective elongate panels may be successively inserted into the cavity 142 of the respective support posts 122, beginning with a bottom most panel, followed by intermediate elongate panels, and concluding with a top most panel. That is, the respective elongate panels may be individually raised to an opening of the cavity 142 at a top side of the support posts 122 and lowered within the cavity 142. The upstanding tongue formations of an elongate panel may mate with an upstanding groove formation of a subsequent elongate panel inserted between the respective posts 122.

In the example of FIG. 4, once the series of elongate panels 124 have been inserted between adjacent support posts 122, a retaining fastener 146 may be inserted proximal to an opening of the cavity 142 of respective support posts for maintaining the stacked plurality of elongate panels between the adjacent support posts 122.

Figure 5B:
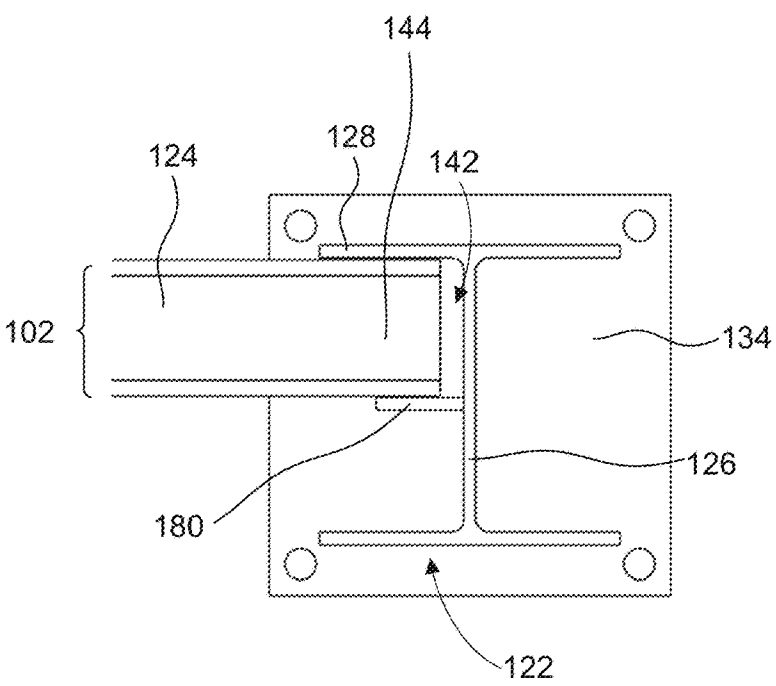
FIGS. 5A and 5B illustrate enlarged, top views of end regions of elongate panels and support posts for the sound wall of FIG. 1.
Figure 5A:
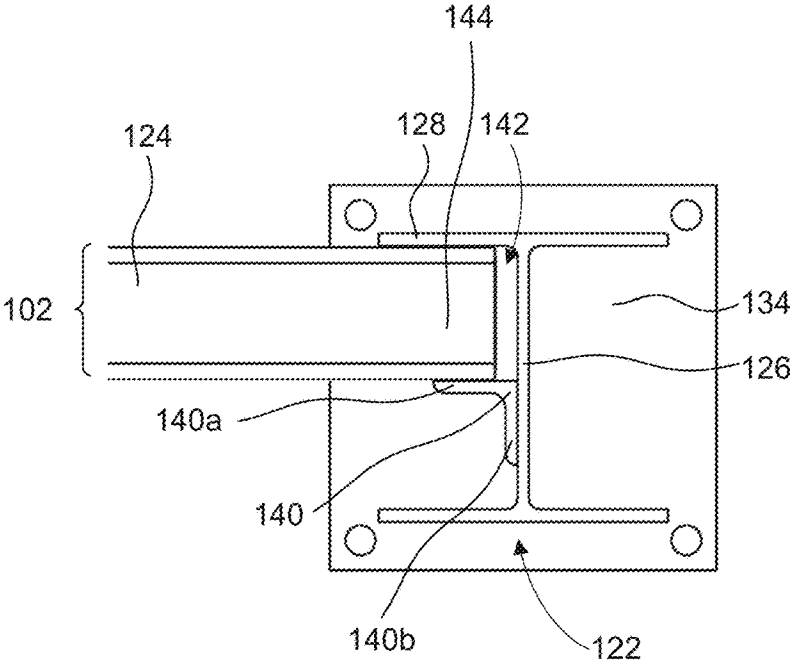

Reference is made to FIGS. 5A and 5B, which illustrate an enlarged, top views of end regions 144 of elongate panels 124 and example support post 122 for the sound wall of FIG. 1.

In FIG. 5A, the support post 122 includes the central member 126, the flange 128 extending along respective member edges of the central member 126, and the fin 140 extending from the central member 126. The cavity 142 is defined by at least a portion of the flange 128, the central member 126, and the fin 140.

The support post 122 may be an elongate post configured to include the central member 126 and opposing flanges 128 positioned substantially normal to the central member 126. The relative dimensions of the central member 126 and the opposing flanges 128 may be sized to withstand torsional, lateral, or other type of load based on environmental factors (e.g., wind load). In some examples, the distance between the opposing flanges 128 may be greater than the panel depth 102 of the plurality of elongate panels 124. To retain the end regions of the elongate panels 124, the support post 122 includes the fin 140 extending from the central member 126, such that the end regions of the respective elongate panels 124 may be retained between one of opposing flanges 128 (illustrated in FIG. 5) and the fin 140.

In the example illustrated in FIG. 5A, the end region of the elongate panel 124 may substantially abut or touch the flange 128 and the fin 140 (e.g., substantially snug fit). In some other embodiments, the end region of the elongate panel 124 may be retained between one of the opposing flanges 128 and the fin 140 without abutment of both the flange 128 and the fin 140. That is, in the present example, there may be a gap between the end region of the elongate panel 124 and one of the opposing flanges 128 and the fin 140.

In FIG. 5A, the fin 140 is configured as an angled device, where the fin 140 may include at least two portions. A first portion 140*a* may be substantially perpendicular to a second portion 140*b* (as illustrated in the top view in FIG. 5A). In FIG. 5A, the fin 140 may be welded to the central member 126 via the second portion 140*b*.

FIG. 5B illustrates a support post 122 including a variant fin 180, in accordance with another embodiment of the present application. The fin 180 may have a substantially rectilinear cross-section (as illustrated in the top view in FIG. 5B) and may be welded to the central member 126. Other shapes or configurations of a fin may be contemplated for retaining an end region 144 of an elongate panel 124 against the flange 128.

The support post 122 may include a mounting base 134 configured to be mounted to support post casing or other anchoring structure.

Figure 6B:
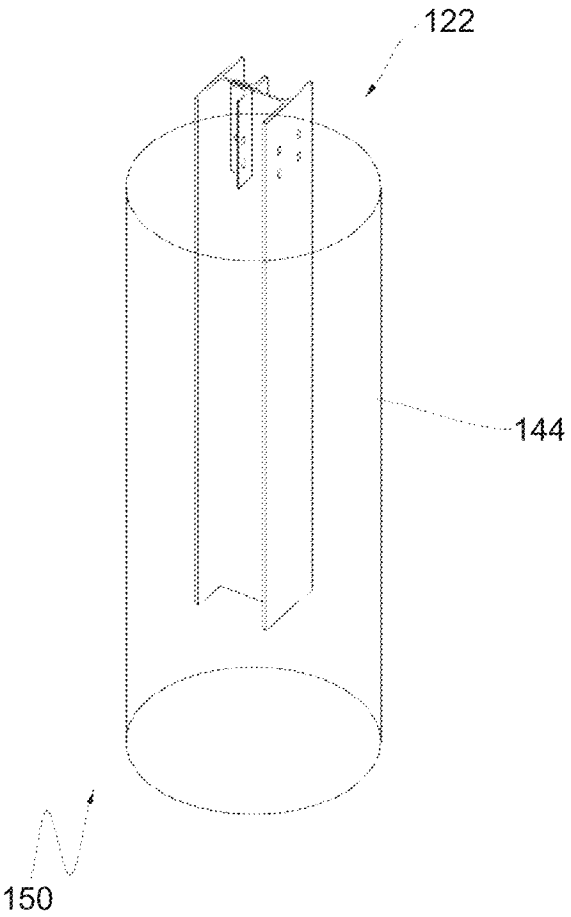
FIGS. 6A and 6B illustrate perspective views of mounting bases.
Figure 6A:
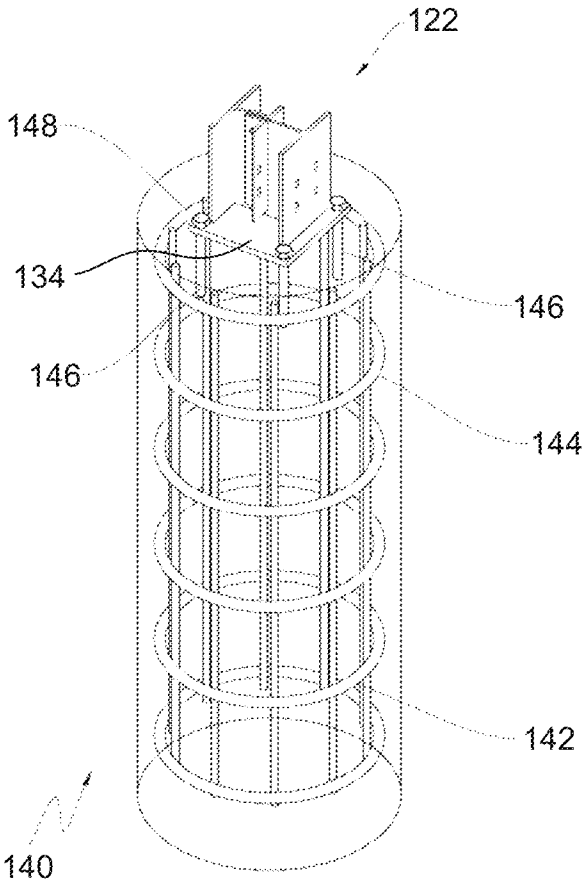

Reference is made to FIGS. 6A and 6B, which illustrate perspective views of mounting bases, in accordance with embodiments of the present application.

FIG. 6A illustrates a partial view of the support post 122 of FIG. 5. The support post 122 may include a substantially rectangular mounting base 134. The mounting base 134 having other geometric shapes may be contemplated.

The mounting base 134 may be secured to a footing 140. In FIG. 6A, the footing includes a cage 142 encased within a concrete casting 144. In some embodiments, the cage 142 or the concrete casting 144 may be generally cylindrical. Other geometric shapes may be contemplated. In the present example, a plurality of spaced apart, threaded rods 146 may extend from a top surface of the concrete casting 144 and pass through corresponding holes provided in the mounting base 134. Threaded nuts 148 may engage the threaded rods 146 to fasten the support post 122 to the footing 140. In some embodiments, the threaded rods 146 may include a series of threaded nuts between which the mounting base 134 may be received. The series of threaded nuts may be configured to adjust an angle between the support post and the grade (e.g., to adjust tilt of the support post relative to the grade).

FIG. 6B illustrates an example of an alternate footing 150. In FIG. 6B, the support post 122 may be devoid of a mounting base. An extended length of the support post 122 may be positioned within the concrete casting 144 to a desired depth to provide support for the support post 122.

In another example, the underlying grade may be devoid of footings and the support post 122 may include features disclosed in U.S. Provisional Patent Application No. 62/795,724 filed on Jan. 23, 2019 and entitled, "Post for a Sound Wall and Sound Wall Employing the Same", the relevant content of which is incorporated herein by reference.

Figure 7B:
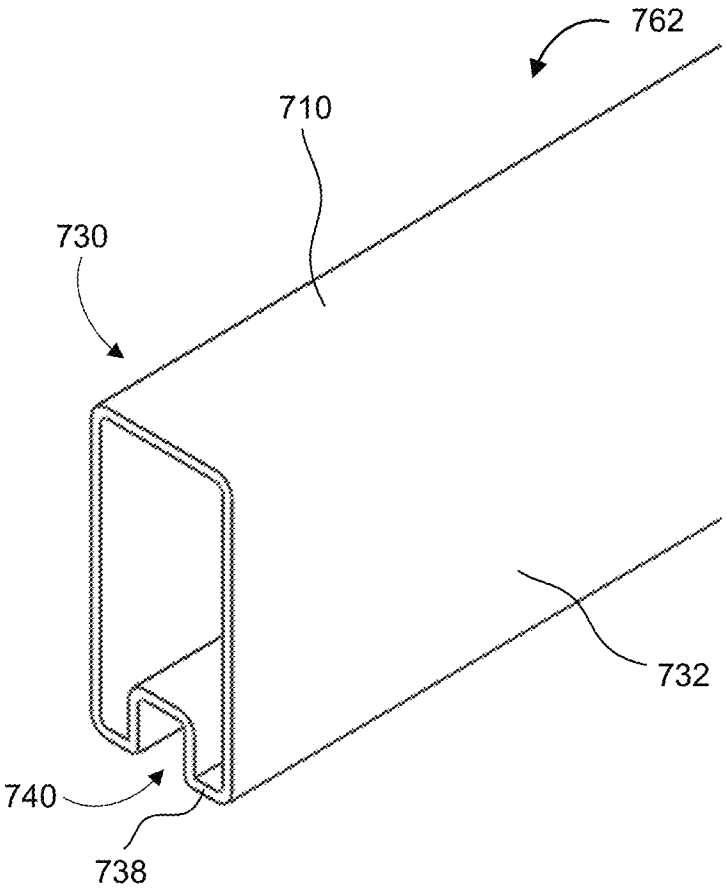
FIGS. 7A and 7B illustrate partial perspective views of elongate panels.
Figure 7A:
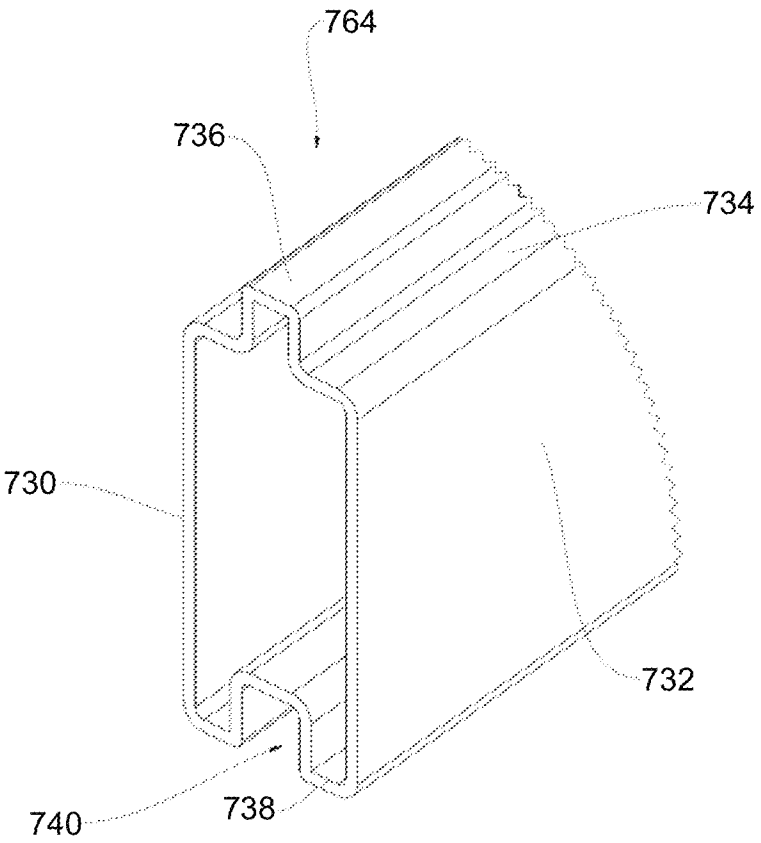

Reference is made to FIGS. 7A and 7B, which illustrate partial perspective views of elongate panels, in accordance with embodiments of the present application. The elongate panels extending between the support posts 122 may include mating formations. As will be described in the present application, the mating formations may be configured to fit adjacent or stacked elongate panels together and to reduce openings between the adjacent elongate panels of the sound wall 100 through which acoustic waves are able to pass unimpeded.

FIG. 7A illustrates a partial perspective view of an intermediate elongate panel 764, in accordance with an embodiment of the present application. The intermediate elongate panel 764 may be an example of an elongate panel of the sound wall 100 of FIG. 1. In the present example, the elongate panel 764 includes mating formations, such as tongue and groove formations complementary in shape, allowing adjacent elongate panels 764 to fit together (e.g., align and interlock). The mating formations may be configured to minimize openings between adjacent elongate panels 764.

Some examples of mating formations may include complementary upstanding groove formations and upstanding tongue formations. Other examples of mating formations may include other geometric configurations.

The elongate panel 764 includes a substantially planar, continuous front wall 730 and a rear wall 732. The front wall 730 and the rear wall 732 respectively extend from one of opposing sides of a top wall 734. The top wall 734 includes an upstanding tongue formation 736.

The elongate panel 764 includes a bottom wall 738 configured, along a central region, to define an upstanding groove formation 740 extending substantially the length of the elongate panel 764. The upstanding groove formation 740 may receive an upstanding tongue formation 736 of an adjacent elongate panel 764, thereby configuring two or more elongate panels 764 to be aligned or interlocked for reducing openings between the series of elongate panels 764 through which acoustic waves or sound may pass.

FIG. 7B illustrates a partial perspective view of a top elongate panel 762, in accordance with an embodiment of the present application. The top elongate panel 762 may be placed at an end of a series of stacked elongate panels. The elongate panel 762 includes a substantially planar top wall 710. The elongate panel 762 includes a substantially planar front wall 730 and rear wall 732 respectively extending from one of opposing sides of the planar top wall 710.

The bottom wall 738 is configured, along a central region, to define an upstanding groove formation 740 extending substantially the length of the elongate panel 762. The upstanding groove formation 740 may receive an upstanding tongue formation 736 of an adjacent intermediate elongate panel 764 illustrated in FIG. 7A.

The substantially planar front wall 730 and rear wall 732 of elongate panels may be configured to reflect acoustic waves from the wall surface or block passage of acoustic waves, thereby reducing acoustic waves from being transmitted from one side of a given elongate panel to an opposing side of the given elongate panel.

Although some embodiments described herein may describe features indicating direction or position (e.g., bottom wall, front wall, rear wall, top wall, lower wall, or the like), in some embodiments, the direction or relative position of the respective wall may not be a requirement of the one or more features. For example, an embodiment of the intermediate elongate panel may include a first end wall including an upstanding tongue. The intermediate elongate panel may include a first side wall and a second side wall extending from opposing sides of the first end wall. Further, the intermediate elongate panel may include a second end wall having a groove formation formed by a pair of inner walls and extending a length of the hollow elongate panel. The groove formation may extend into the hollow elongate panel. Accordingly, references to top wall, bottom wall, front wall, rear wall, or the like are for convenience, and in some embodiments the direction or relative position of the wall shall not be limiting.

Figure 8B:
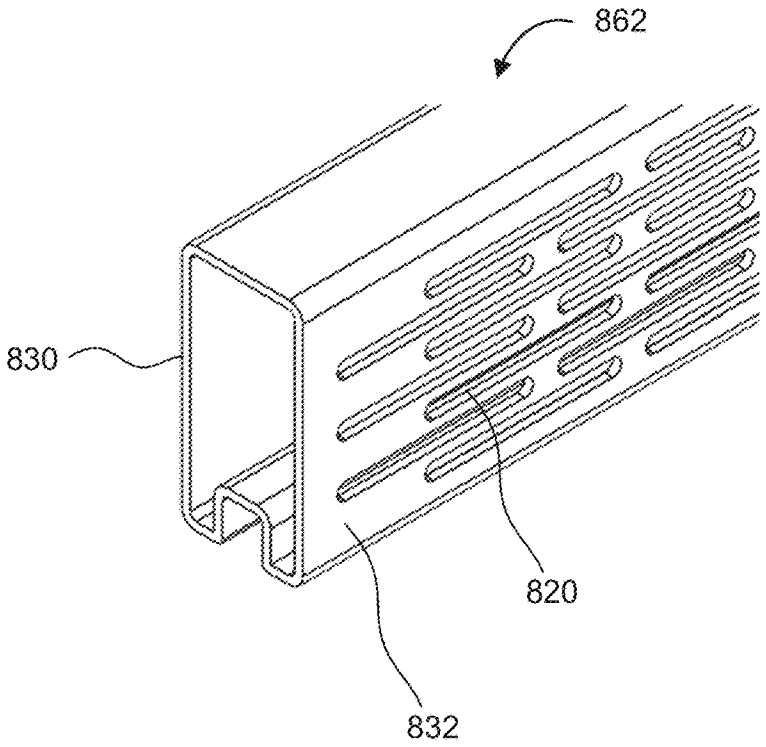
FIGS. 8A and 8B illustrate partial perspective views of elongate panels.
Figure 8A:
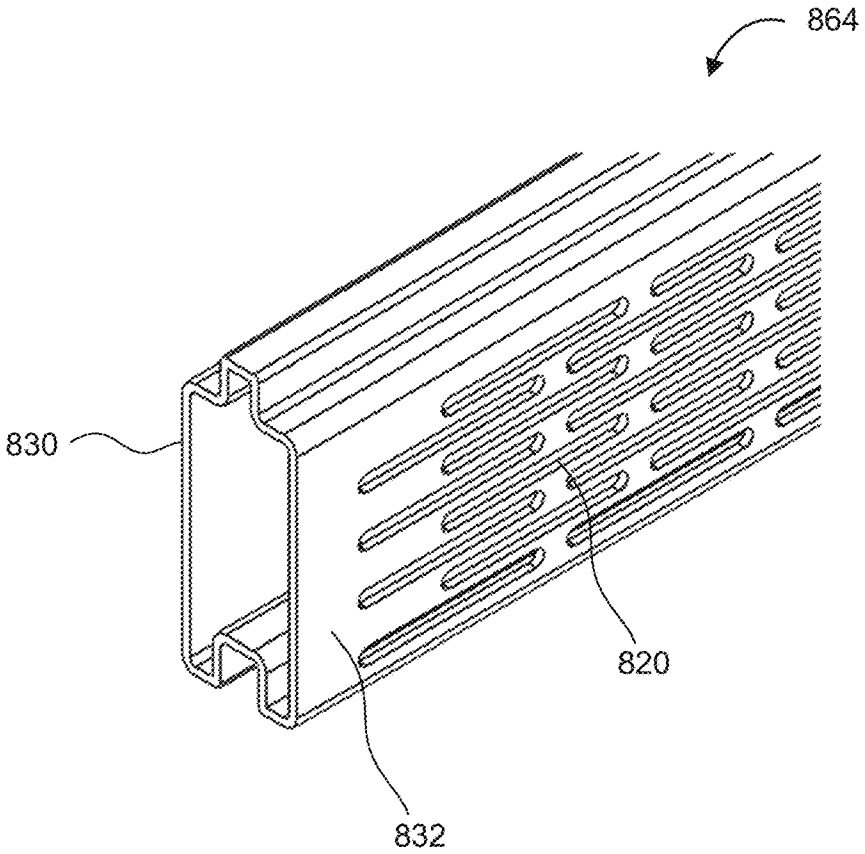

In some embodiments, elongate panels may be configured to reduce acoustic waves from being transmitted through a sound wall by dampening acoustic waves using an absorptive member. Reference is made to FIGS. 8A and 8B, which illustrate partial perspective views of elongate panels, in accordance with embodiments of the present application.

FIG. 8A illustrates an example elongate panel 864 similar to the intermediate elongate panel 764 of FIG. 7A, and further includes an array of slots 820 formed in a rear wall 832 or a front wall 830 of the elongate panel 864. Acoustic mineral wool or other sound dampening material may be placed within the elongate panel 864 to fill the hollow core of the elongate panel 864.

FIG. 8B illustrates an example elongate panel 862 similar to the elongate panel 762 illustrated in FIG. 7B, and further includes an array of slots 820 formed in a rear wall 832 or a front wall 830 of the elongate panel 862. In some embodiments, acoustic mineral wool or other sound dampening material may be placed within the elongate panel 862. The absorptive material may reduce the quantity of acoustic waves passing through the array of slots 820 and reducing reflection of acoustic waves incident on the front wall 830 or the rear wall 832.

Figure 9:
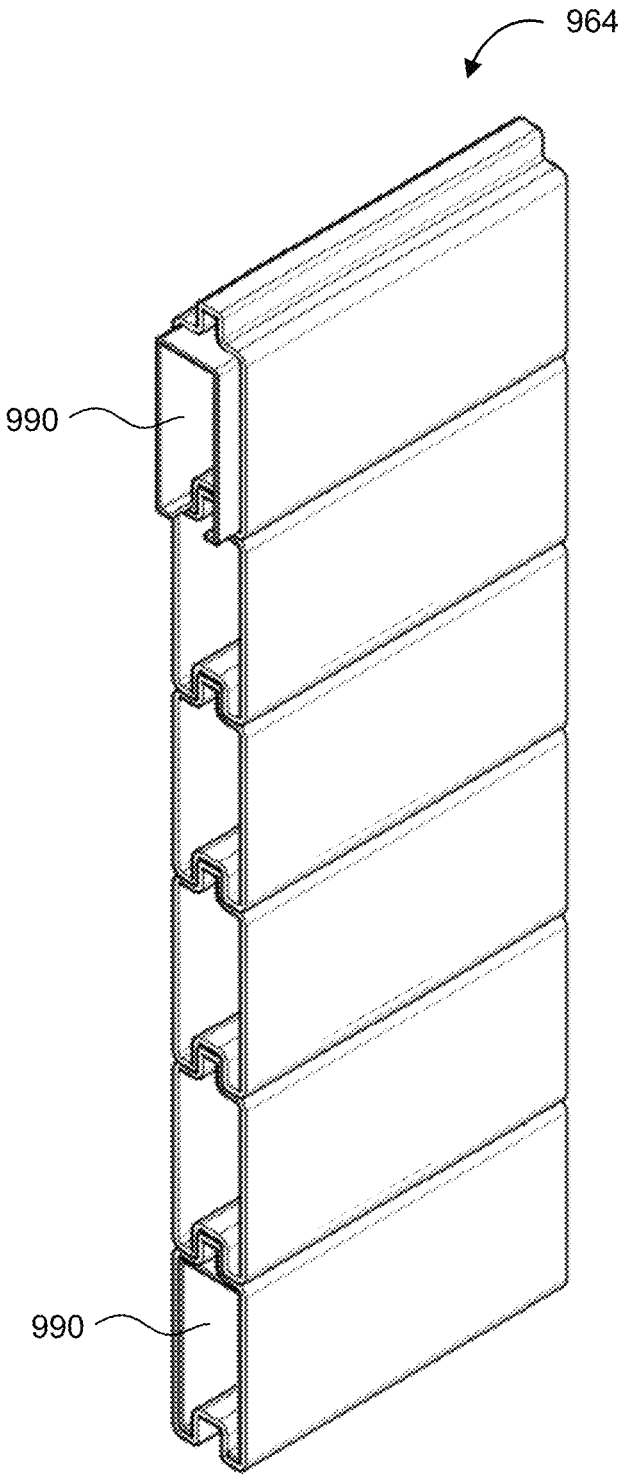
FIG. 9 illustrates a series of elongate panels.

Reference is made to FIG. 9, which illustrates a series of elongate panels 964, in accordance with an embodiment of the present application. The series of intermediate panels 964 may include one or more intermediate panels accommodating an elongate stiffener member 990. The respective intermediate panels may have a hollow core for receiving or accommodating the elongate stiffener member 990. The elongate stiffener member 990 may extend substantially the length of the respective elongate panel. For ease of exposition, the top most elongate panel in FIG. 9 illustrates the elongate stiffener member 990 as protruding from an end of the intermediate panel. However, the elongate stiffener member 990 may be substantially the same length of the respective elongate panel and may be configured to line one or more interior surfaces of the intermediate panel. In some embodiments, the elongate stiffener member 990 may be shorter in length than the elongate panel and may be configured to line a sub-portion of the one or more interior surfaces of the intermediate panel.

In FIG. 9, the elongate stiffener member 990 may be placed within panels at opposing ends (e.g., top end or bottom end) of the series of intermediate panels 964. It may be appreciated that, in some embodiments, any number of intermediate panels in the series may accommodate the elongate stiffener member 990.

Figure 10:
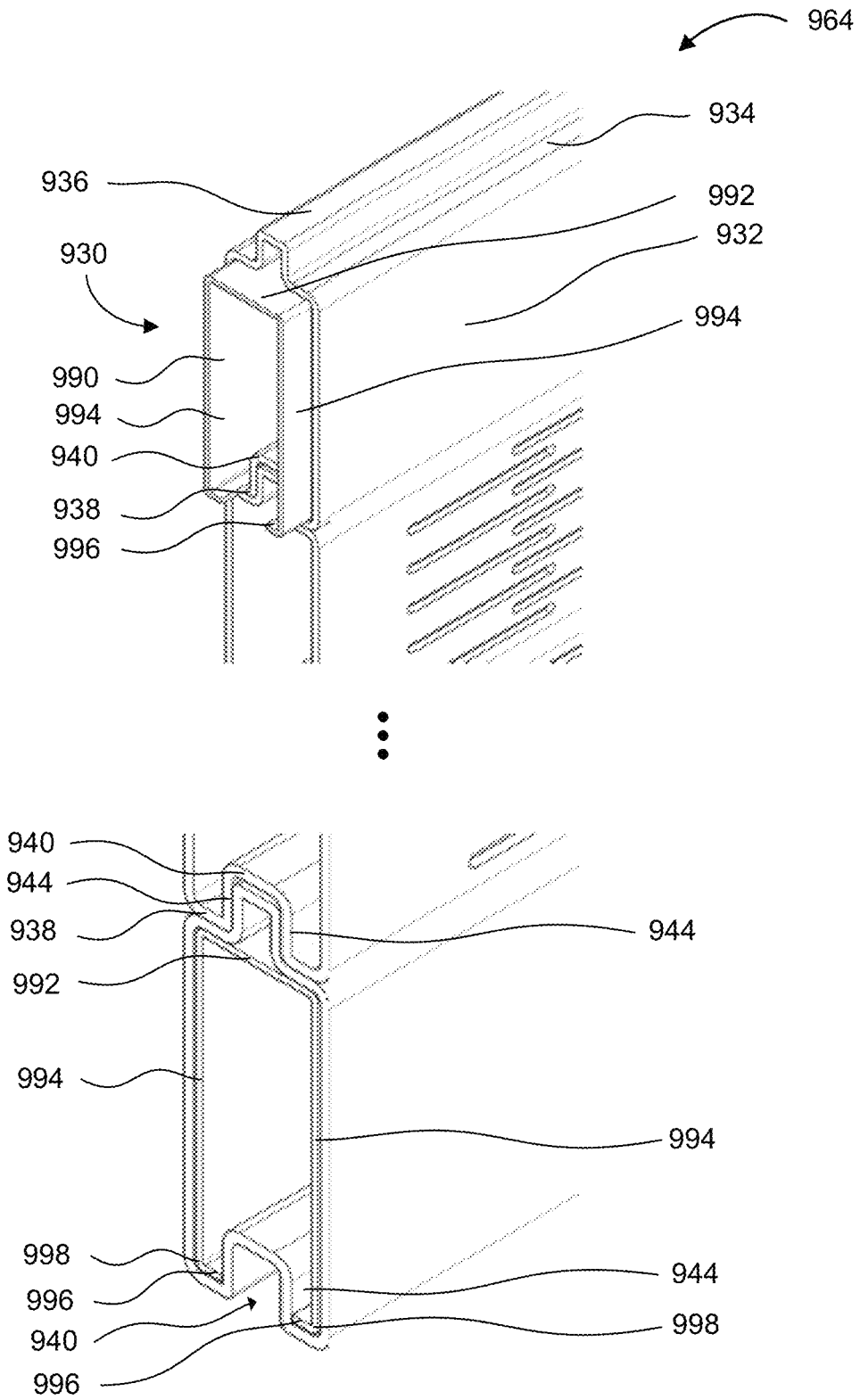
FIG. 10 illustrates an enlarged view of elongate panels in the series of elongate panels of FIG. 9.

Reference is made to FIG. 10, which illustrates an enlarged view of the top most elongate panel and the bottom most elongate panel in the series of intermediate panels 964 illustrated in FIG. 9. The respective intermediate panels in the series of intermediate panels 964 include a top wall 934. The respective intermediate panels include a front wall 930 and a rear wall 932 respectively extending from one of opposing sides of the top wall 934. In some embodiments, the top wall 934 of the intermediate panel may include an upstanding tongue formation 936 configured to be received within an upstanding groove formation 940 of an adjacent panel. That is, the upstanding tongue formation 936 and the upstanding groove formation 940 may be complimentary in shape allowing adjacent intermediate panels to fit together (i.e., align and interlock) or may be otherwise configured to structurally engage with each other. The interlocking of adjacent intermediate panels may be configured to minimize openings between the intermediate panels through which sound is able to pass unimpeded.

In some embodiments, adjacent intermediate panels 964 may be affixed together based on an adhesive or bonding agent at one or more contact planes of the upstanding tongue formation 936 and the upstanding groove formation 940. In some embodiments, the upstanding tongue formation 936 and the upstanding groove formation 940 may include features for mechanically engaging the formations to one another. Features to engage the upstanding tongue formation 936 and the upstanding groove formation 940 combination can increase propensity of the series of panels 964 to counteract lateral forces on the sound wall.

The respective intermediate panels include a bottom wall 938 joining the front wall 930 and the rear wall 932. The bottom wall 938 may include the upstanding groove formation 940, where the upstanding groove formation 940 may be formed by a pair of inner walls 944. The pair of inner walls 944 may delineate the sides of the upstanding groove formation 940. The bottom wall 938 and the upstanding groove formation 940 may extend substantially the length of the respective intermediate panels.

As described, one or more of the series of intermediate panels 964 may accommodate a stiffener member 990. The stiffener member 990 may include a bight member 992 having opposing ends. The bight member 992 may be substantially planar. The bight member 992 may abut and lie against at least a portion of the top wall 934 and may span an interior channel of an interior channel defined by the upstanding groove formation 936.

The stiffener member 990 includes a pair of arm members 994 respectively extending from one of the opposing ends of the bight member 992 to provide a substantially U-shaped configuration. For example, the U-shaped configuration may be seen when viewed from an end of the stiffener member 990.

In some embodiments, the stiffener member having the U-shaped configuration may be constructed with material including metal having a given thickness. When the stiffener member having the given material thickness (e.g., thickness A) is received within one of the intermediate panels 964, the stiffener member may provide reinforcing structural support to that intermediate panel 964, reducing torsional flexing or reducing deflection in response to wind loads.

To reduce manufacturing cost or to reduce panel weight, it may be desirable to provide a stiffener member constructed of comparatively thinner material for providing substantially similar reinforcing structural support as a U-shaped stiffener member having "thickness A". Accordingly, embodiments described in the present application include stiffener member features configured to reduce buckling of the stiffener member 990.

For example, the stiffener member 990 may include a flange member 996 extending from each of the pair of arm members 994. The flange member 996 may extend inwardly to abut one of the pair of inner walls 944 of the groove formation 940. As illustrated in FIG. 10, the flange member 996 may extend substantially orthogonally from a distal end 998 of the respective arm members 994 to abut one of the pair of inner walls 944 of the groove formation 940. That is, the flange member 996 may extend substantially orthogonally from the distal end 998 of the respective arm members 994 to touch one of the pair of inner walls 944. In some scenarios, the respective flange member 996 abuts an inner wall 944 of the groove formation 940 to resist inward buckling of the elongate stiffener member 990 within the respective intermediate panel. By including flange members 996 to resist inward buckling of the elongate stiffener member 990, the stiffener member 990 may be able to provide substantially similar reinforcing structural support as compared to a stiffener member constructed of thicker material and without the flange members. That is, when the flange members 996 resist inward buckling of the elongate stiffener member 990, the respective intermediate panels may be strengthened to resist bending or deformation.

The elongate stiffener member 990 may be configured to line interior surfaces of one or more of the series of intermediate panels 964. For example, the pair of arm members 994 may be configured to respectively abut and/or lie against one of the front wall 930 or the rear wall 932 of the hollow elongate intermediate panel. Further, the respective flange member 996 may be configured to abut and/or lie against at least a portion of the bottom wall 938. Additionally, the bight member 992 may be configured to abut and/or lie against a portion of the top wall 934.

Where the top wall 934 includes the upstanding tongue formation 936, the bight member 992 may span an interior channel defined by the upstanding tongue formation 936.

As will be described in another embodiment of the present application, the bight member 992 may be configured to include an upstanding formation corresponding to the upstanding tongue formation 936, such that the upstanding formation may fit within the interior channel defined by the upstanding tongue formation 936.

In some embodiments, the elongate stiffener member 990 may be constructed of a unitary component such that the bight member 992, the pair of arm members 994, and the flange members 996 may be a unitary component.

In some other embodiments, during manufacturing, the flange member 996 may be affixed or joined using adhesive, welding, or other affixing means to a respective arm member of the pair of arm members 994. Further, the respective arm member may be joined to one of the opposing ends of the bight member 992 to provide the elongate stiffener member 990.

In some embodiments, the stiffener member 990 may be constructed of cold formed steel or other structural material for extending substantially the length of the elongate panel. In some embodiments, the stiffener member 990 may be constructed of aluminum. In some examples, cold formed steel may be constructed by roll forming elongate metal strips. Other processes for constructing cold formed steel may be contemplated.

The stiffener member 990 described with reference to FIG. 9 and FIG. 10 may be configured to fit within an elongate hollow intermediate panel. It may be appreciated that the stiffener member 990 described with reference to FIG. 9 and FIG. 10 may also be suitable for fitting within a top most elongate panel, such as the example top elongate panel illustrated in FIG. 7B or 8B.

In some examples, when the top most elongate panel and the bottom most elongate panel are configured to receive a stiffener member therein, the combination of the top most elongate panel, the bottom most elongate panel, and the support posts retaining respective end regions of the of elongate panels may effectively provide a frame for reducing torsional force effects on the sound wall or elongate panels.

Figure 11B:
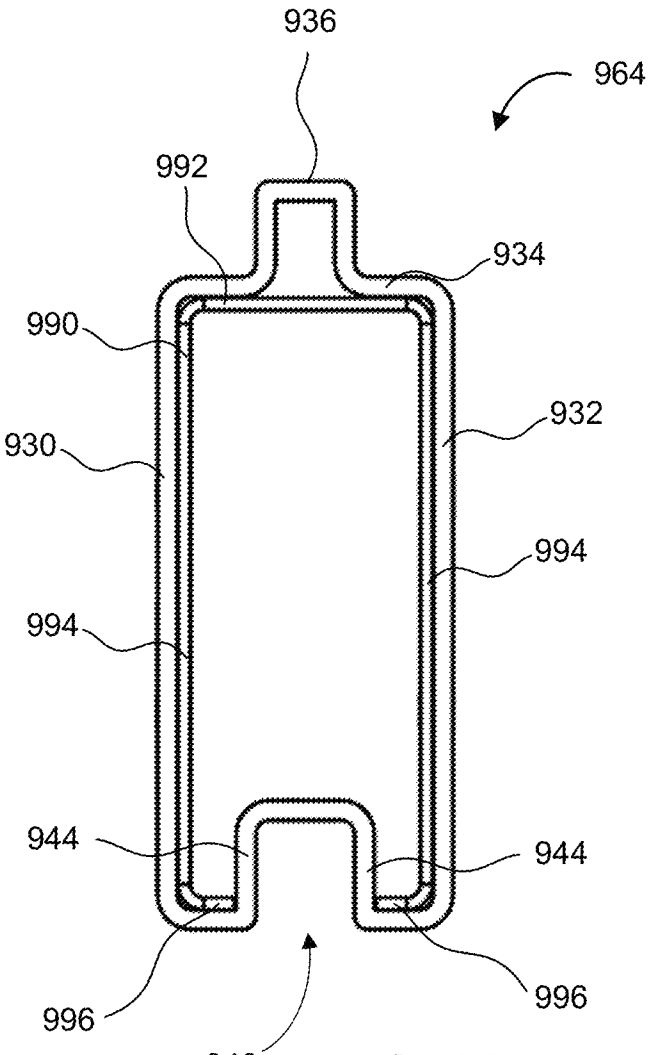
FIGS. 11A and 11B illustrate a side view of a stiffener member and a side view of the stiffener member received within a hollow elongate panel, respectively.
Figure 11A:
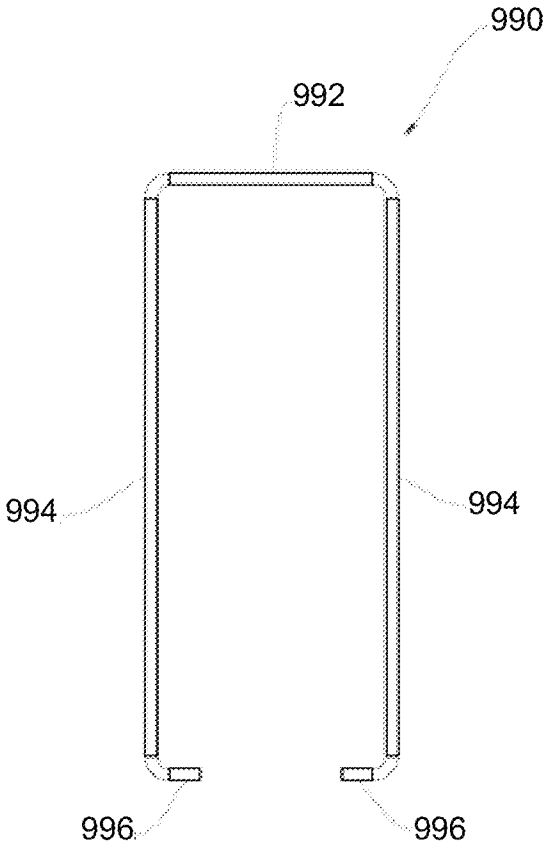

FIGS. 11A and 11B illustrate a side view of a stiffener member and a side view of the stiffener member received within a hollow elongate panel, respectively, in accordance with embodiments of the present application.

In FIG. 11A, the stiffener member 990 includes a bight member 992 having opposing ends. The stiffener member 990 includes a pair of arm members 994 respectively extending from one of the opposing ends of the bight member 992 to provide a substantially inverted U-shaped configuration. The stiffener member 990 includes a flange member 996 extending from each of the pair of arm members 994.

In FIG. 11B, the stiffener member 990 is received within the elongate panel 964. The flange members 996 extend inwardly to abut one of the pair of inner walls 944 of an upstanding groove formation 940 of an elongate panel 964. The flange members 996 abut a respective inner wall 944 to resist inward buckling of the stiffener member 990 within the elongate panel 964. By including flange members 996 to resist inward buckling of the stiffener member 990, the stiffener member 990 may be able to provide similar reinforcing structural support as compared to a stiffener member constructed of thicker material and without the flange members.

The stiffener member 990 may be oriented within the elongate panel 964 such that the bight member 992 is configured to abut or lie against a portion of the top wall 934. The pair of arm members 994 may be configured to abut or lie against one of the front wall 930 or the rear wall 932. The flange members 996 may be configured to abut or lie against a portion of the bottom wall 938.

Figure 12B:
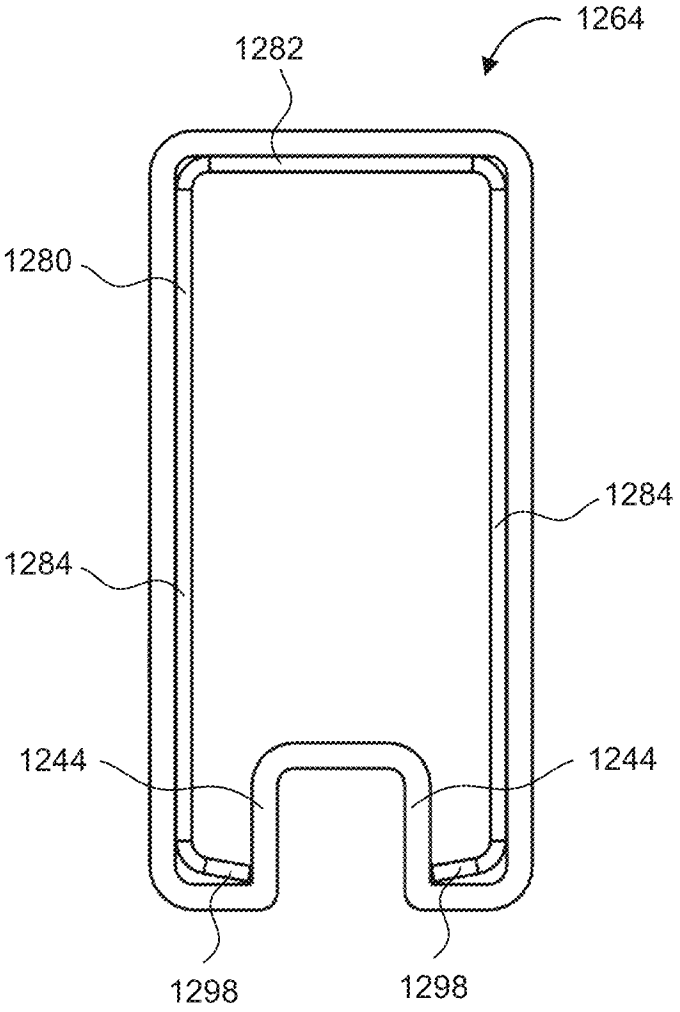
FIGS. 12A and 12B illustrate side views of alternate stiffener members.
Figure 12A:
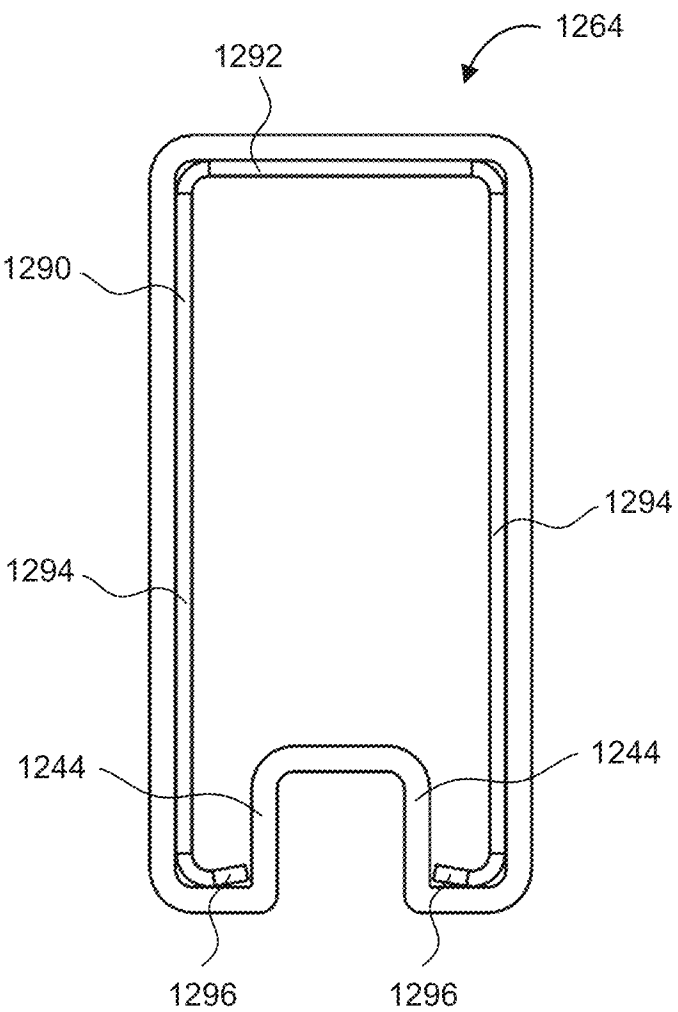

Reference is made to FIGS. 12A and 12B, which illustrate side views of stiffener members, in accordance with embodiments of the present application.

FIG. 12A illustrates a stiffener member 1290 including a bight member 1292 having opposing ends, and a pair of arm members 1294 respectively extending from one of the opposing ends of the bight member 1292 to provide a substantially inverted U-shaped configuration. The stiffener member 1290 is received within the elongate panel 1264. The elongate panel 1264 includes an upstanding groove formation having inner walls 1244.

The stiffener member 1290 includes a flange member 1296 extending from each of the pair of arm members 1294. The flange member 1296 extends inwardly to abut one of the pair of inner walls 1244 of the upstanding groove formation. In the example illustrated in FIG. 12A, an angle between the flange members 1296 and a respective arm member 1294 is an acute angle.

FIG. 12B illustrates an alternate stiffener member 1280 including a bight member 1282 having opposing ends, and a pair of arm members 1284 respectively extending from one of the opposing ends of the bight member 1282 to provide a substantially inverted U-shaped configuration.

The stiffener member 1280 includes a flange member 1298 extending from each of the pair of arm members 1284, and extending inwardly to abut one of the pair of inner walls 1244. In FIG. 12B, an angle between the flange members 1298 and a respective arm member 1284 is an obtuse angle.

Figure 13B:
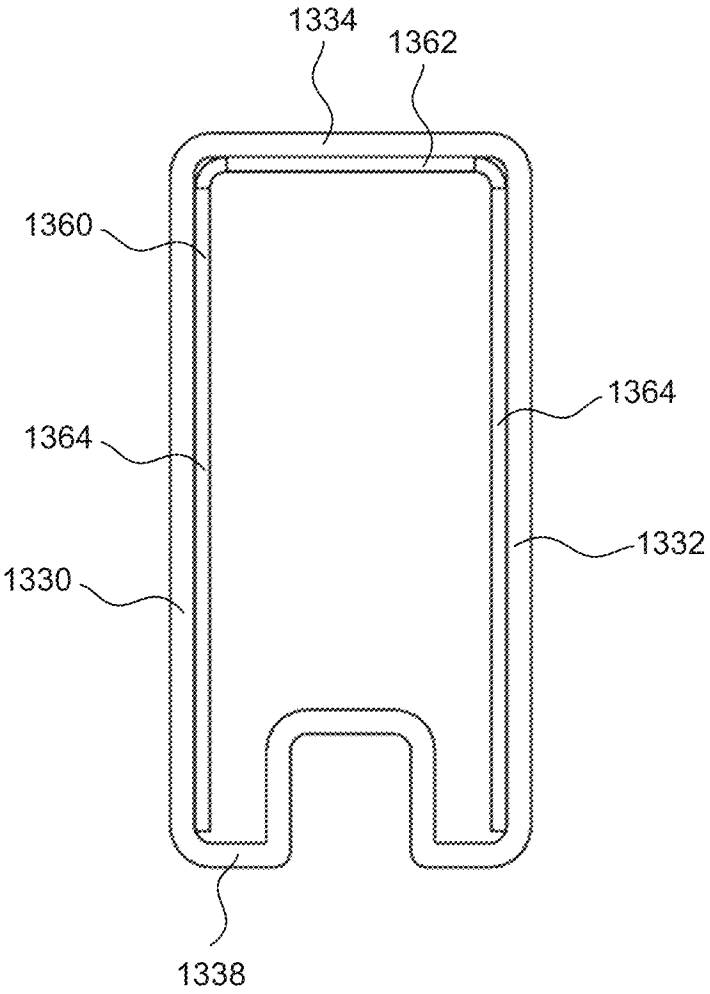
FIGS. 13A and 13B illustrate side views of alternate stiffener members.
Figure 13A:
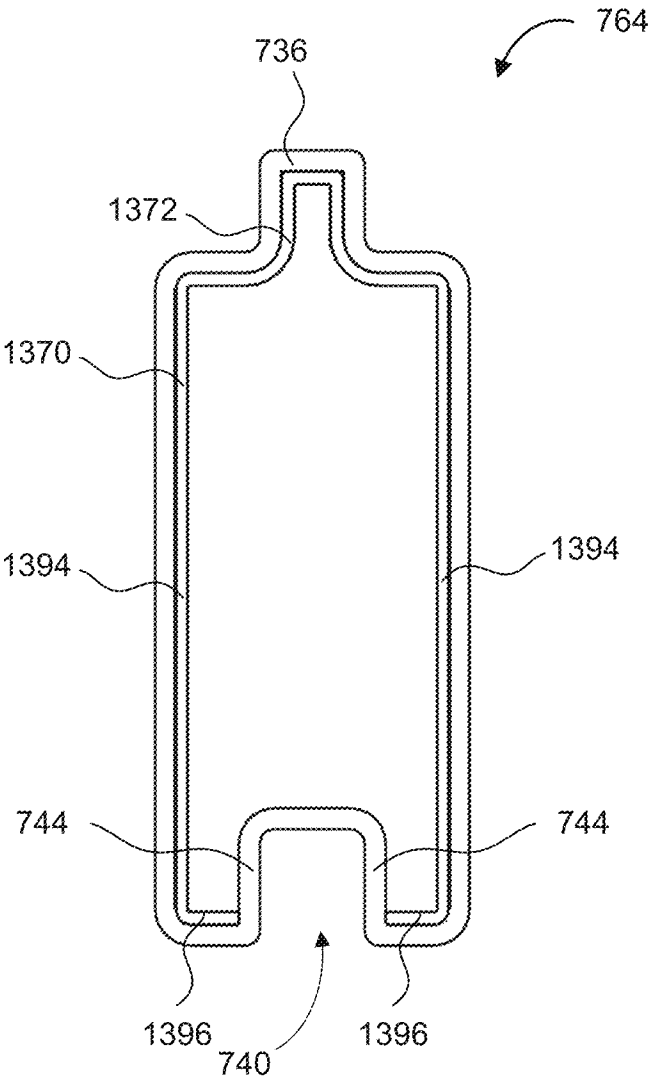

Reference is made to FIGS. 13A and 13B, which illustrate side views of stiffener members, in accordance with further embodiments of the present application.

FIG. 13A illustrates an elongate panel similar to the elongate panel 764 illustrated in FIG. 7A. The elongate panel 764 includes mating formations, such as the upstanding groove formation 740 and the upstanding tongue formation 736.

In FIG. 13A, a stiffener member 1370 is received within the elongate panel 764 and lines or is proximal to at least some portions of inner walls of the elongate panel 764. The stiffener member 1370 includes a pair of arm members 1394 respectively extending from one of the opposing ends of a bight member 1372 of the stiffener member. The stiffener member 1370 includes a flange member 1396 extending from each of the pair of arm members 1394, and may extend inwardly to abut one of the pair of inner walls 744.

In FIG. 13A, the bight member 1372 may be configured to include a formation corresponding to the upstanding tongue formation 736. In the present example, the bight member 1372 may substantially line an interior surface of the upstanding tongue formation 736.

FIG. 13B illustrates a stiffener member 1360 includes a bight member 1362 and a pair of arm members 1364 respectively extending from one of the opposing ends of the bight member 1362. In the example illustrated in FIG. 13B, the stiffener member 1360 may be devoid of flange members extending from the pair of arm members 1364. In the present example, the stiffener member 1360 may substantially line an interior surface that corresponds to a front wall 1330, a rear wall 1332, and the top wall 1334, and may not line the bottom wall 1338.

Figure 14:
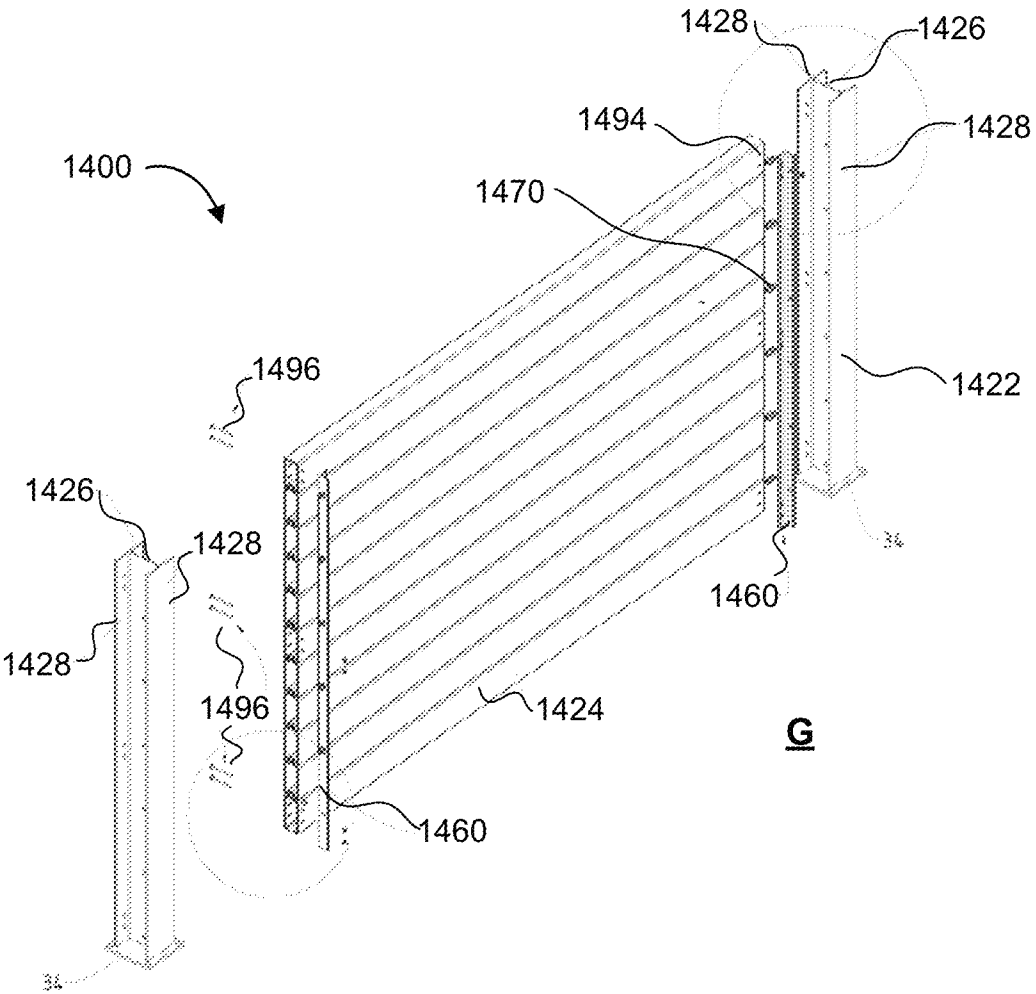
FIG. 14 illustrates a partially exploded, perspective view of a sound wall.
Figure 15:
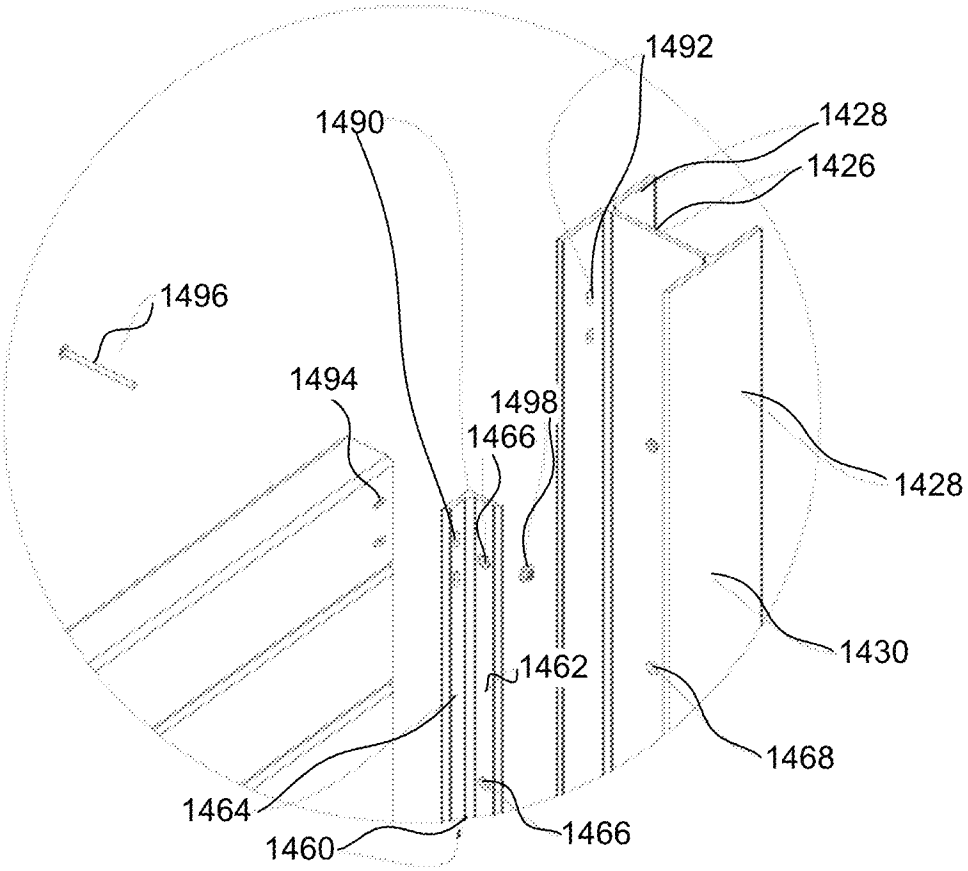
FIG. 15 illustrates an enlarged exploded perspective view of end regions of the sound wall of FIG. 14.

Reference is made to FIGS. 14 and 15, which illustrate a partial exploded, perspective view of an alternate sound wall 1400 and an enlarged exploded perspective view of end regions, respectively, in accordance with embodiments of the present application.

The sound wall 1400 includes elongate tie members 1460 associated with support posts 1422. When installed, the elongate tie members 1460 may be configured to be generally vertical or substantially perpendicular to the grade G. The tie members 1460 may be configured to secure elongate panels 1424 to the support posts 1422.

The tie members 1460 may be configured to form an angle including a pair of flanges (identified by reference numerals 1462 and 1464 in FIG. 15). The pair of flanges may be configured to be substantially perpendicular to one another. A first flange 1462 may overlie a portion of a central member 1426 of a support post 1422. The first flange 1462 may include a plurality of spaced holes 1466 and may be configured to align with corresponding holes 1468 of the central member 1426. Fasteners 1470 may be configured to pass through the first flange 1462 and the central member 1426 via the aligned holes 1466, 1468 to secure the first flange 1462 to the central member 1426.

In some embodiments, the fasteners 1470 include a bolt that passes through the first flange 1462 and central member 1426 via the aligned holes 1466, 1468, and a nut is threaded onto a distal end of the bolt. In some examples, washers may be placed between the nut and one major surface of the central member 1426 and another washer may be placed between the head of the bolt and the other major surface of the central member 1462. Alternate fastening methods (such as rivets, welds, etc.) to secure the first flange 1462 to the central member 1426 may be contemplated. Example alternate fastening methods are described in the present application.

The second flange 1464 may be substantially parallel to one or more flanges 1428 of the support post 1422. End regions of the series of elongate panels 1424 may be sandwiched, trapped, or retained between the second flange 1464 and a flange 1428 of the support post 1422.

The second flange 1464 may include a plurality of spaced holes 1490 for aligning with: (i) panel slots 1494; (ii) slots positioned on an end region of a stiffener member received within respective elongate panels; and (iii) spaced holes positioned in a flange 1428 of the support post 1422. Fasteners 1496 may be threaded through the above described holes and slots and configured to fasten the series of elongate panels 1424 to the support post. The fasteners 1496 may respectively pass through: (a) the flange 1428 of the support post; (b) a respective elongate panel 1424 (including any stiffener member received therein); (c) the second flange 1464, via aligned holes and slots, and/or (d) a nut 1498 threaded onto a distal end of the fastener 1496. Other fastening methods and mechanisms for securing the second flange 1496 to end regions of the series of elongate panels 1424 may be contemplated. Example alternate fastening methods are described in the present application.

Although a single tie member associated with each support post may be described, variations may be contemplated. For example, in environments where the height of a sound wall is significant, each tie member may be in the form of a series of discrete and aligned tie member segments. Each tie member segment may be associated a subset of the series of stacked elongate panels. Each tie member segment may physically secure elongate panels in the associated subset to the associated support post. In some examples, each subset of elongate panels may comprise one or more elongate panels that accommodate a stiffener member.

Figure 16:
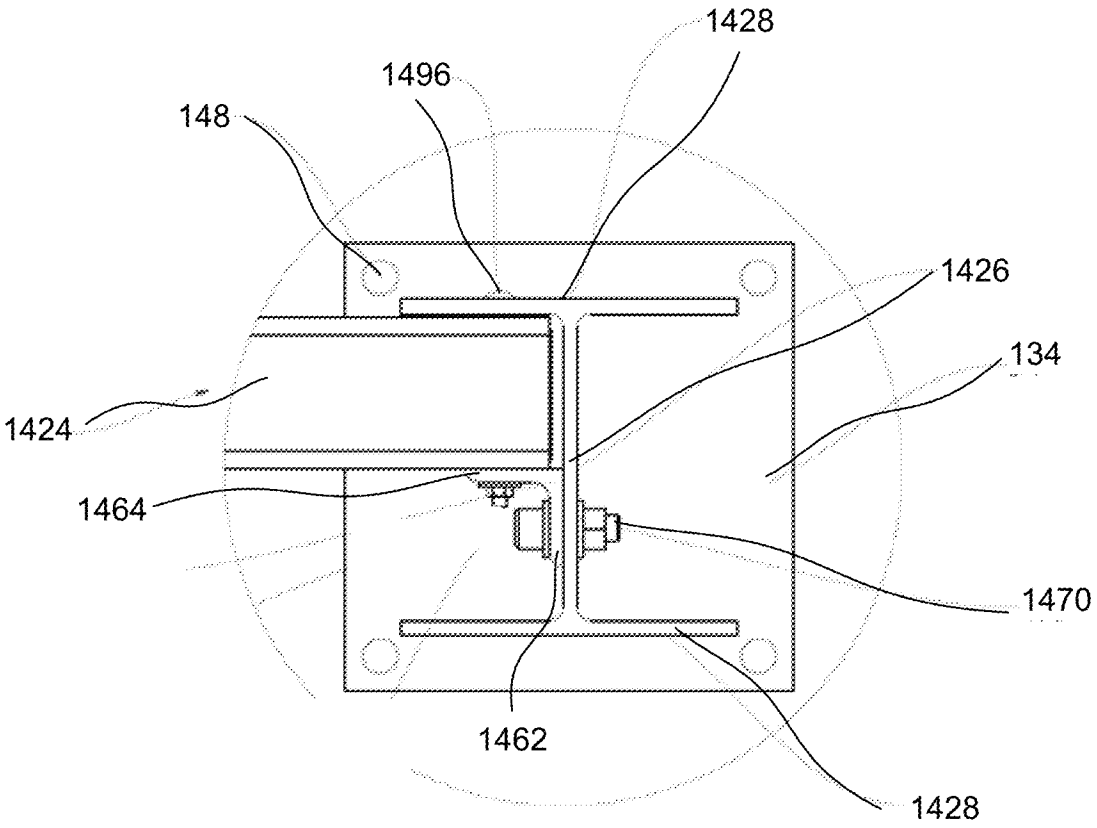
FIG. 16 illustrates an enlarged top view of an end region of the sound wall of FIG. 14.

Reference is made to FIG. 16, which illustrates an enlarged top view of an end region of the sound wall of FIG. 14.

The tie member 1460 is fastened to the support post 1422 by the fastener 1470. The fastener 1470 includes a bolt and a nut. Once the bolt is received through aligned holes of the first flange 1462 and the central member 1426, the nut may be threaded onto a distal end of the bolt.

The tie member 1460 may also be fastened to the elongate panel 1424 by a second fastener 1496. The second fastener 1496 may include a bolt and a nut. Once the bolt is received through aligned holes of the flange 1428 of the support post, the elongate panel 1424 (including any stiffener member received therein), and the second flange 1464, the nut may be threaded onto a distal end of the bolt.

In the example illustrated in FIG. 16, end regions of respective elongate panels may be retained between the flange 1428 of the support post 1422 and the tie member 1460.

Securing one or more elongate panels, such as the top most or bottom most panels of a series of panels, to support posts, the likelihood that the elongate panels in the series of stacked panels may be pushed out of the cavity defined at least by portions of the flange (of the support post), the central member, and the tie member or fin described in the present application may be reduced.

In some examples, an intermediate panel between the top most panel and the bottom most panel may additionally be secured to: (i) the flange 1428 of the support post; (ii) the second flange 1464 of the tie member 1460; or (iii) both the flange of the support post and the second flange 1464 of the tie member 1460.

In some embodiments, operations for constructing a sound wall include mounting a plurality of support posts at laterally spaced locations on a grade (e.g., underlying earth formation). The support posts may be mounted to be substantially perpendicular to the grade. The plurality of elongate panels may be successively received within respective cavities of the adjacent support posts. The respective elongate panels may extend between the adjacent support posts and be retained within the respective cavities of the support posts.

In some examples, the plurality of elongate panels are inserted between the adjacent support posts one at a time, in series. In some other examples, the plurality of elongate panels may be joined to form a combination unit and, subsequently, the combination unit may be raised and inserted to an opening of cavities of the support posts and inserted between the adjacent support posts.

When the plurality of elongate panels are in place/inserted between adjacent support posts, the fasteners 1496 may be inserted to secure, at least, one or more elongate panels to the tie member 1460 via the plurality of spaced holes 1490. Further, the tie member 1460 may be secured to the central member 1426 of an associated support post.

Figure 17B:
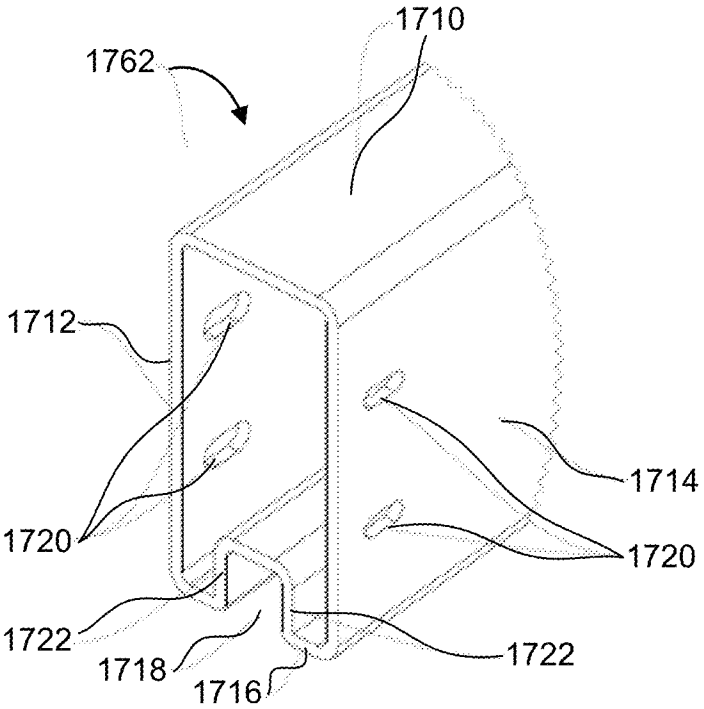
FIGS. 17A and 17B illustrate partial perspective views of elongate panels.
Figure 17A:
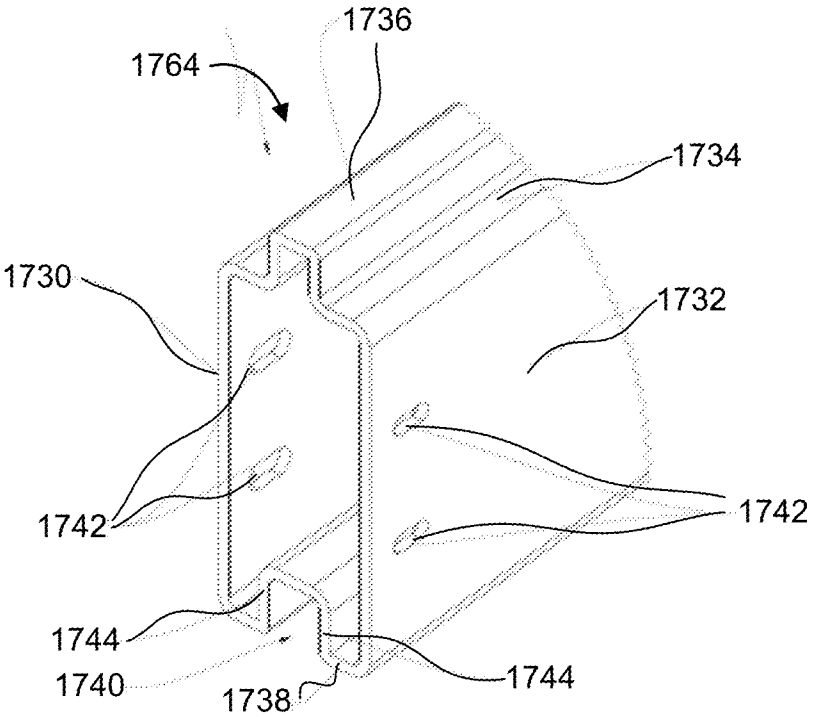

Reference is made to FIGS. 17A and 17B, which illustrate partial perspective views of elongate panels, in accordance with embodiments of the present application.

FIG. 17A illustrates a partial perspective view of an intermediate elongate panel 1764 that may include features similar to the intermediate elongate panel 764 illustrated in FIG. 7A. For example, the intermediate elongate panel 1764 may include a top wall 1734 having an upstanding tongue formation 1736. The intermediate elongate panel 1764 includes a front wall 1730 and a rear wall 1732 respectively extending from one of opposing sides of the top wall 1734.

The intermediate elongate panel 1764 includes a bottom wall 1738 configured, along a central region, to define an upstanding groove formation 1740 extending substantially the length of the elongate panel 1764.

The intermediate elongate panel 1764 may also include elongate slots 1742 positioned in the front wall 1730 and the rear wall 1732 at an end region of the elongate panel. The elongate slots 1742 may be configured to receive fasteners 1496 described with reference to FIGS. 14 to 16 for retaining the end regions of the elongate panel 1764 between the flange 1428 of the support post 1422 and the tie member 1460. In some embodiments, the elongate slots 1742 may be similar to the panel slots 1494 illustrated in FIG. 15.

In some embodiments, the elongate slots 1742 may be configured to receive fasteners for retaining the end regions of the elongate panel 1764 between the flange 128 of the support post 122 (FIG. 2) and a fin 140 (FIG. 1). In some embodiments, the fin may be configured with corresponding apertures for receiving the fasteners for retaining the end regions of the elongate panel 1764 between the flange 128 of the support post and the fin.

FIG. 17B illustrates a partial perspective view of a top elongate panel 1762, in accordance with an embodiment of the present application. The top elongate panel 1762 may be placed at an end of a series of stacked elongate panels. The top elongate panel 1762 may include features similar to the top elongate panel 762 illustrated in FIG. 7B. For example, the top elongate panel 1762 may include a substantially planar top wall 1710, and a substantially planar front wall 1712 and rear wall 1714 respectively extending from one of opposing sides of the planar top wall 1710.

The top elongate panel 1762 includes a bottom wall 1716 configured, along a central region, to define an upstanding groove formation 1718 extending substantially the length of the elongate panel 1762.

The top elongate panel 1762 includes elongate slots 1720 positioned in the front wall 1712 and the rear wall 1714 at an end region of the elongate panel. The elongate slots 1720 may be configured to receive fasteners 1496 for retaining the end regions of the elongate panel between the flange of a support post and at least one of: (a) a tie member (described with reference to FIG. 14) or (b) a fin (described with reference to FIG. 3) having apertures for receiving fasteners. The elongate slots 1720 may be similar to the panel slots illustrated in FIG. 15.

Figure 18B:
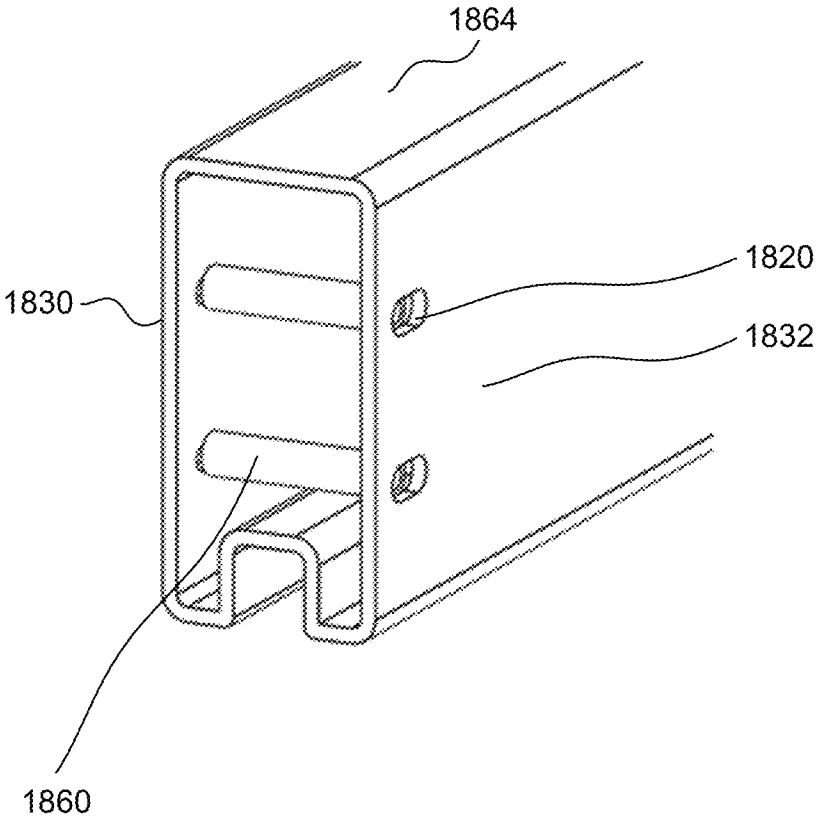
FIG. 18B illustrates a perspective view of a conduit and an elongate panel.
Figure 18A:
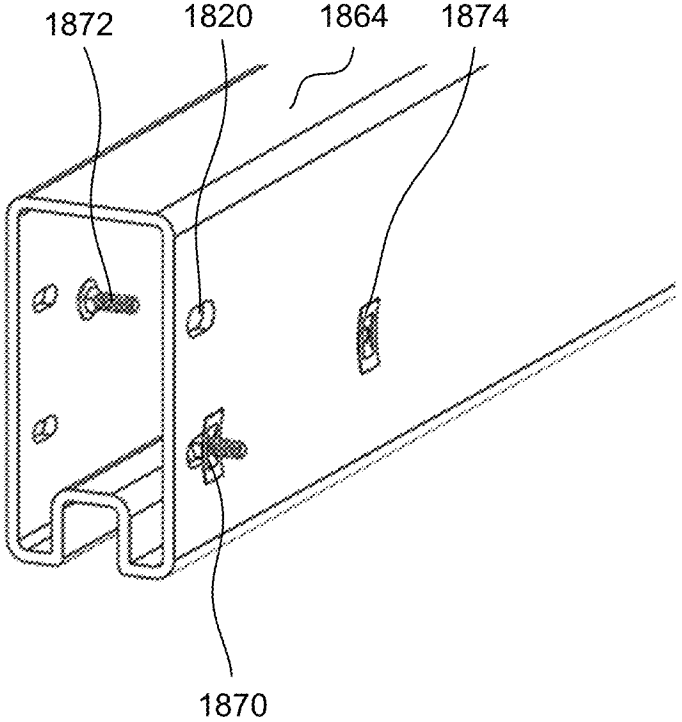
FIG. 18A illustrates a perspective view of a fastener assembly and an elongate panel.

Reference is made to FIG. 18A, which illustrates a perspective view of a fastener assembly 1870 and an elongate panel 1864, in accordance with an embodiment of the present application. The fastener assembly 1870 may be configured for securing the elongate panel 1864 to a tie member (e.g., time member 1460 described with reference to FIG. 14) or to a flange 1428 (FIG. 14) of a support post.

It may be appreciated that, in some embodiments, the fin 140 described with reference to FIG. 3 may include one or more spaced holes thereon and the elongate panel 1864 illustrated in FIG. 18A may be secured to the fin 140. In FIG. 1, the fin 140 may be welded to the support post.

The fastener assembly 1870 may include a carriage bolt 1872 and a speed clip 1874. The carriage bolt 1872 may be placed within elongate slots 1820 of the elongate panel 1864 and may be secured or threaded to the speed clip 1874. FIG. 18A illustrates an exploded view of the fastener assembly 1870 and an assembled view of the fastener assembly 1870 received within an elongate slot 1820.

Reference is made to FIG. 18B, which illustrates a perspective view of a conduit 1860 and an elongate panel 1864, in accordance with an embodiment of the present application. The conduit 1860 may be a hollow cylindrical structure, or a hollow structure having any other geometric configuration. The conduit 1860 may extend between a front wall 1830 and a rear wall 1832 of the elongate panel 1864. The conduit 1860 may be configured to extend between the front wall 1830 and the rear wall 1832 while being aligned with a pair of corresponding elongate slots 1820 of the elongate panel 1864. The conduit 1860 may allow fasteners, such as the carriage bolt 1872 (FIG. 18A), to be readily threaded or inserted through the elongate panel 1864 during sound wall installation.

Figure 19B:
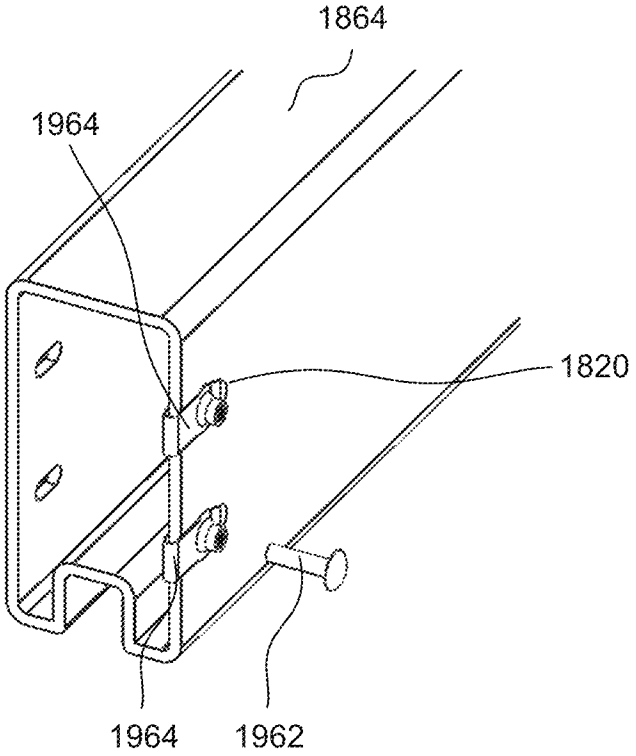
FIGS. 19A and 19B illustrate perspective views of alternate fastener assemblies.
Figure 19A:
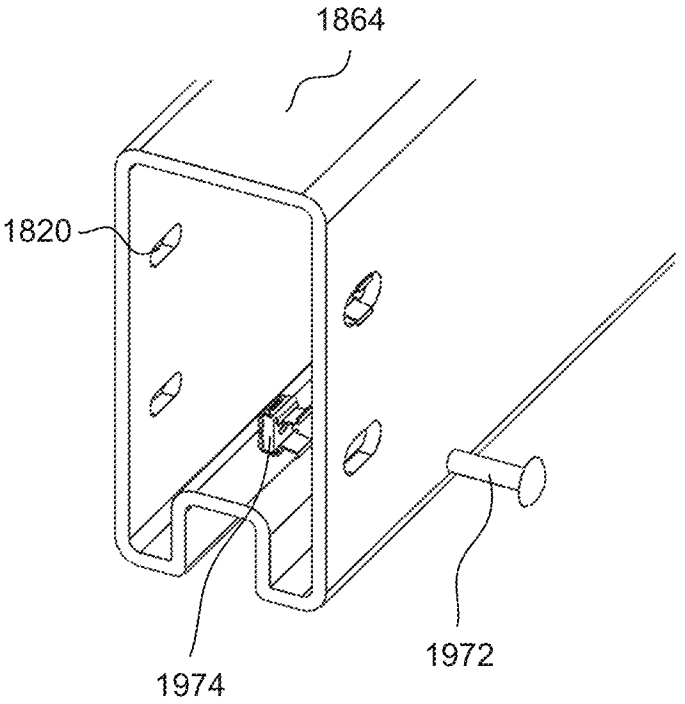

Reference is made to FIGS. 19A and 19B, which illustrate perspective views of alternate fastener assemblies, in accordance with embodiments of the present application.

FIG. 19A illustrates the elongate panel 1864 and elongate slots 1820 positioned on the front wall and the rear wall of the elongate panel 1864. A fastener assembly including a bolt 1972 and a cage nut 1974 may be configured to secure the elongate panel 1864 to a tie member or to a flange of a support post. The bolt 1972 may include various example of bolts, such as carriage bolts, self tapping screws, or other types of bolts.

FIG. 19B illustrates another example fastener assembly including a bolt 1962 and an extruded U-nut 1964. The extruded U-nut may be configured to be positioned about an elongate slot 1820 and configured to receive the bolt 1962 for securing the elongate panel 1864 to a tie member or to a flange of a support post.

In some situations, by structurally enhancing one or more elongate panels with elongate stiffener members and by securing the elongate panels to embodiment support posts described in the present application, deflection of a series of stacked panels may be reduced or minimized.

Further, in some situations, structurally enhancing one or more elongate panels with elongate stiffener members may allow lateral spacing between adjacent support posts to be greater as compared to lateral spacing between adjacent support posts of a sound wall devoid of structurally stiffened elongate panels. By structurally enhancing the one or more elongate panels with elongate stiffener members, the elongate panels may experience reduced sagging or lateral deformation due to wind loads or other forces acting on the sound wall.

Figure 20:
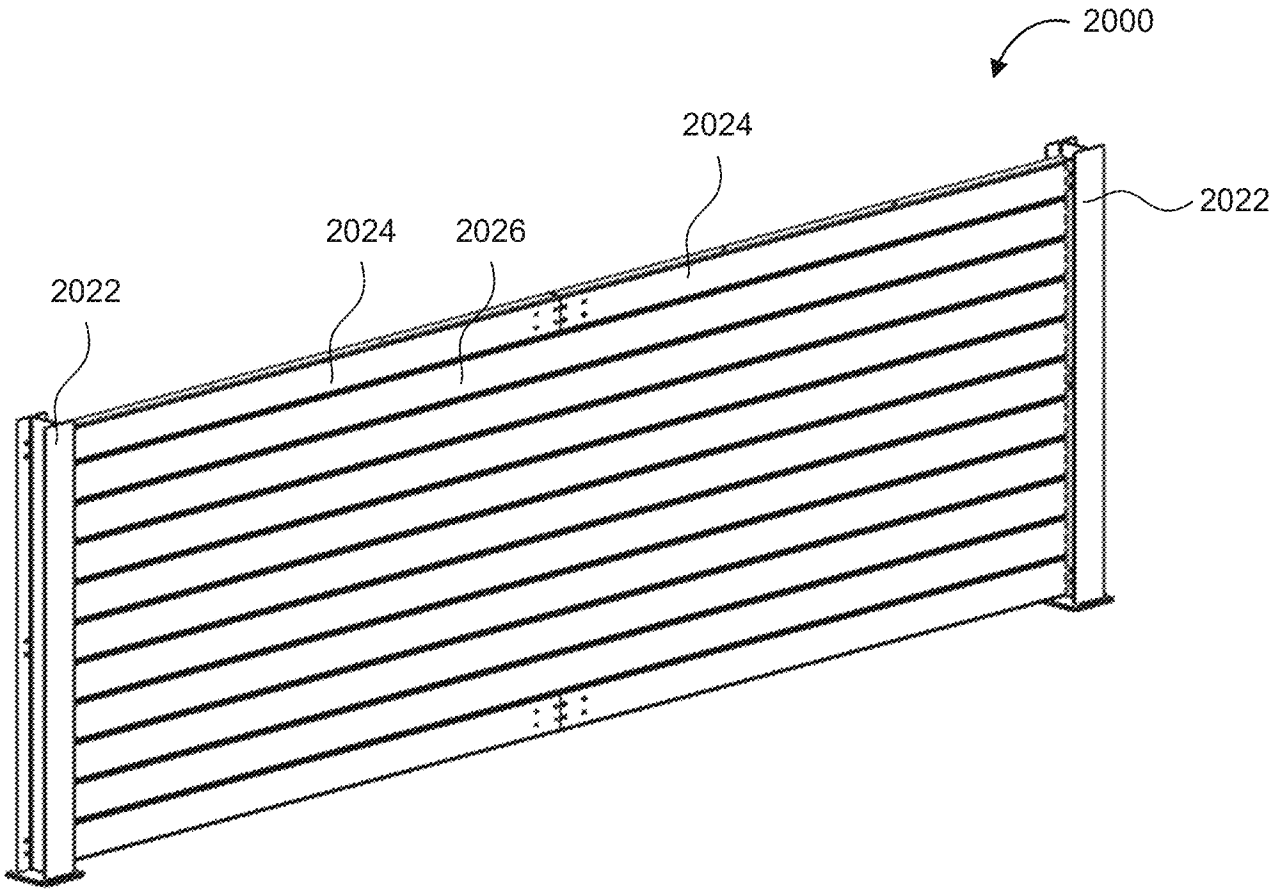
FIGS. 20 and 21 illustrate a perspective view of another embodiment of a sound wall and a partially exploded view of the sound wall, respectively.
Figure 21:
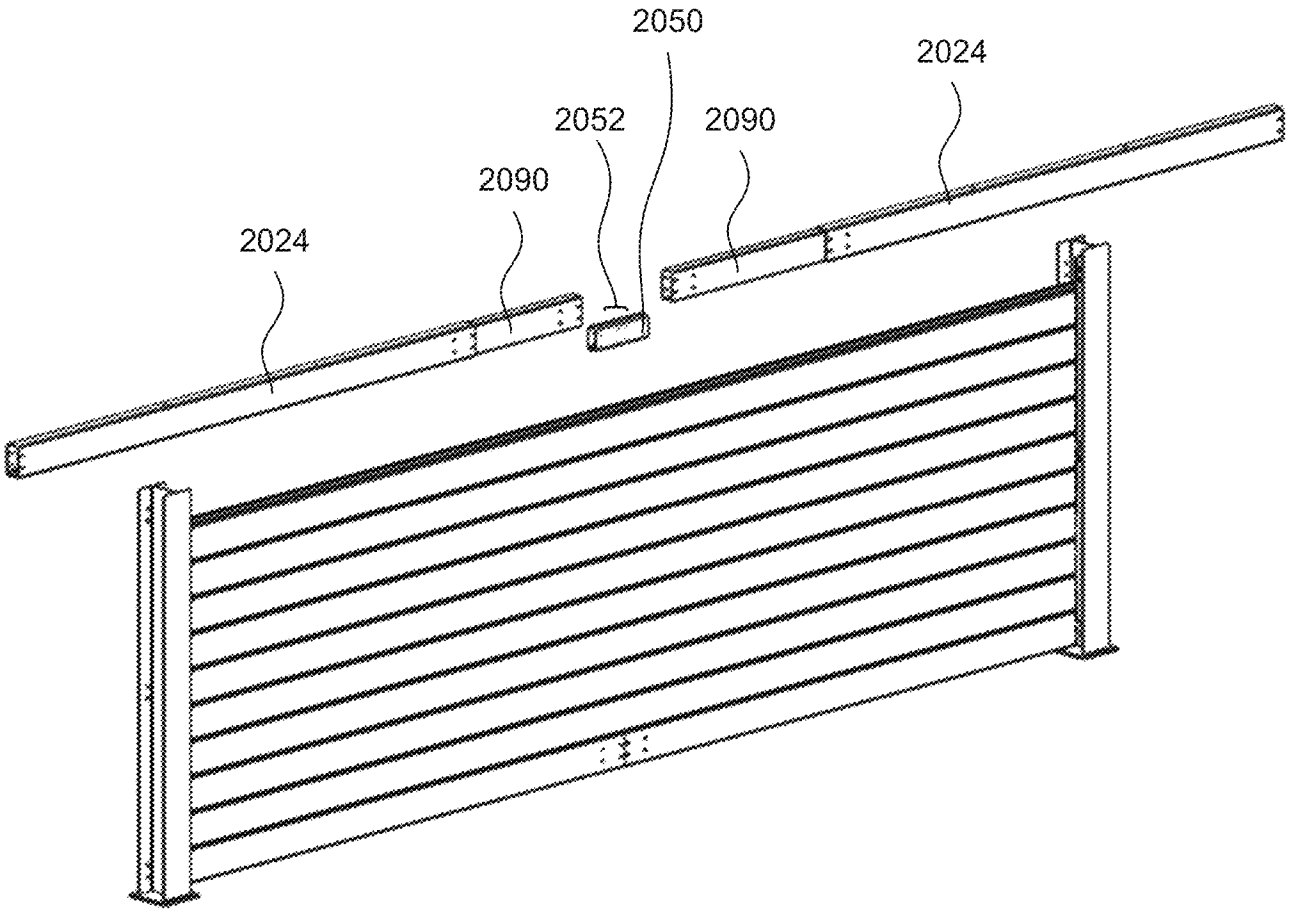

Reference is made to FIGS. 20 and 21, which illustrate a perspective view of a sound wall 2000 and a partially exploded view of the sound wall 2000, respectively, in accordance with embodiments of the present application.

The sound wall 2000 includes at least a pair of support posts 2022 and a plurality of elongate panels extending between the support posts 2022. The plurality of elongate panels may include one or more continuous length elongate panels 2026 and one or more sets of joined elongate panels 2024. In some embodiments, the one or more sets of joined elongate panels 2024 may be reinforced with stiffener members received therein. Similar to the sound wall described with reference to FIGS. 1 and 2, the combination of the support posts 2022 and the one or more sets of joined elongate panels with stiffener members received therein may define a frame for retaining the plurality of elongate panels 2026 within the sound wall.

In FIG. 21, a set of joined elongate panels 2024 may include corresponding stiffener members 2090 received within respective elongate panels 2024. Further, a joiner panel 2050 may be received within and at an interface of abutting ends of elongate panels 2024 for joining the respective elongate panels 2024. The joiner panel 2050 may be configured to be received within the respective elongate panels 2024 and one or more stiffener members 2090 (in scenarios where the stiffener members 2090 are received within the respective elongate panels).

The joiner panel 2050 may include one or more joiner apertures 2052 within a front wall or a rear wall of the joiner panel 2050, and the joiner apertures 2052 may be configured to align with one or more slots positioned on the respective elongate panels 2024 and the one or more stiffener members 2090, if installed.

Figure 22B:
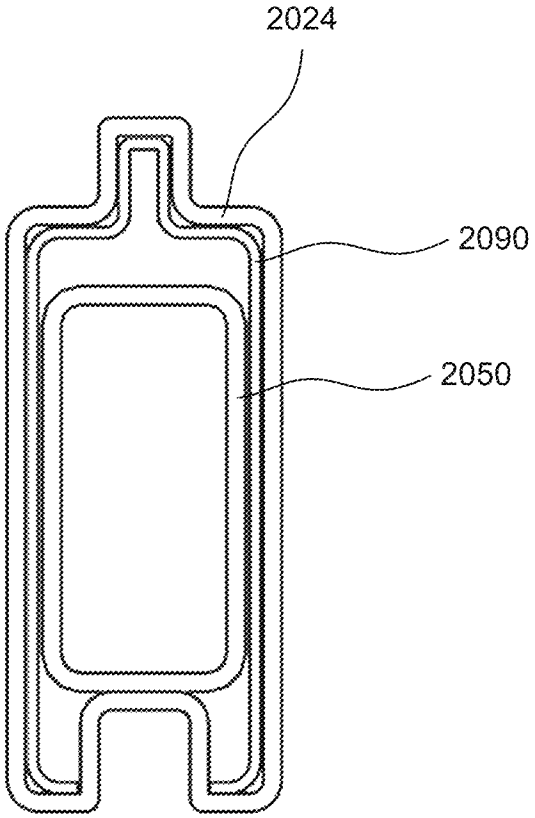
FIGS. 22A and 22B illustrate a perspective view of abutting elongate panels and a side view of the abutting elongate panels, respectively.
Figure 22A:
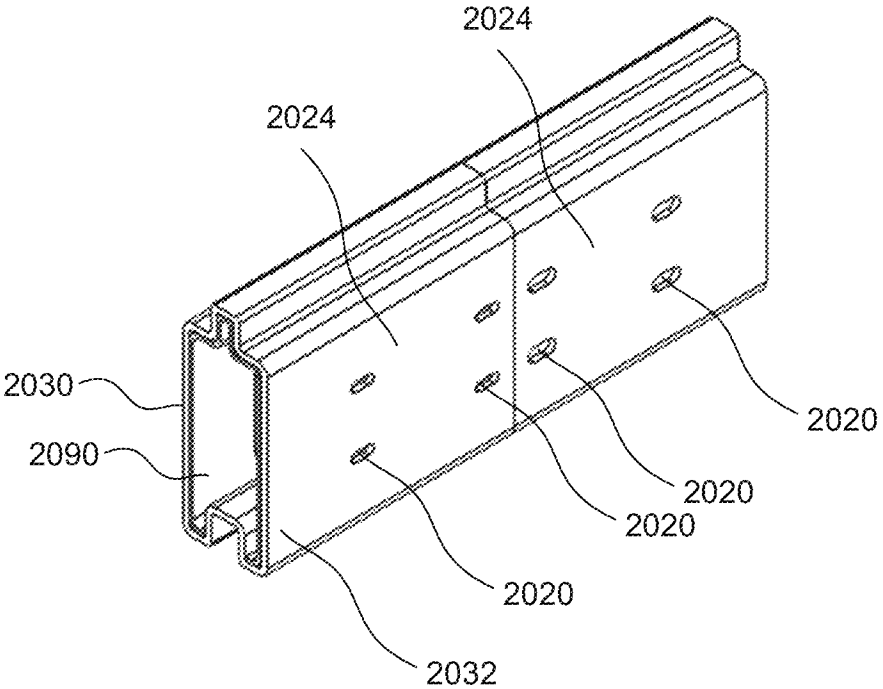

Reference is made to FIGS. 22A and 22B, which illustrate a perspective view of abutting elongate panels 2024 and a side view of the abutting elongate panels 2024, respectively, in accordance with embodiments of the present application. For ease of exposition, FIG. 22A illustrates a relatively shortened elongate panels 2024 for illustrating positioning of adjacent elongate panels 2024.

FIG. 22A illustrates one or more slots 2020 positioned on a front wall 2030 or a rear wall 2032 of the respective elongate panels 2024. The one or more slots 2020 may be configured to receive fastener assembly components, such as carriage bolts, screws, dowels, or the like. When a combination of adjacent elongate panels 2024, corresponding stiffener members 2090, and the joiner panel 2050 (FIG. 22B) is assembled such that joiner apertures 2052 are aligned with: (a) one or more slots 2020 of the respective elongate panels 2024; and (b) one or more slots of the stiffener members 2090, fasteners may be inserted within the aligned slots and joiner apertures 2052 such that the combination of components are affixed to form a combined structure. The joiner panel 2050 (illustrated in FIG. 21) may be configured for combining abutting elongate panels 2024 to provide a lengthier resultant elongate panel. The lengthier resultant elongate panel may be configured to extend the distance between adjacent support posts 2022 of a given sound wall. Further, by structurally enhancing elongate panels 2024 joined by the joiner panel 2050, the combination of elongate panels 2024, stiffener members 2090, and joiner panels 2050 may be configured to reduce deflection or deformation of sound wall components due to external forces (e.g., lateral wind forces, etc.).

FIG. 22B illustrates a side view of the set of joined elongate panels 2024. The set of joined elongate panels 2024 includes the one or more stiffener members 2090 received within the elongate panels 2024. The one or more stiffener members 2090 may be any one of the plurality of embodiments of stiffener members described in the present application. Further, the set of joined elongate panels 2024 includes the joiner panel 2050 received within the set of joined elongate panels 2024.

As described in the present application, mating formations may be configured to fit adjacent or stacked elongate panels together and to reduce openings between the elongate panels of the sound wall through which acoustic waves may pass unimpeded. In some embodiments, it may be desirable to affix the series of elongate panels based in part on the mating formations. That is, by adhesively or mechanically affixing complementary mating formations of respective elongate panels to one another, the structural integrity of the series of elongate panels, as a combination, may be increased.

Figure 23B:
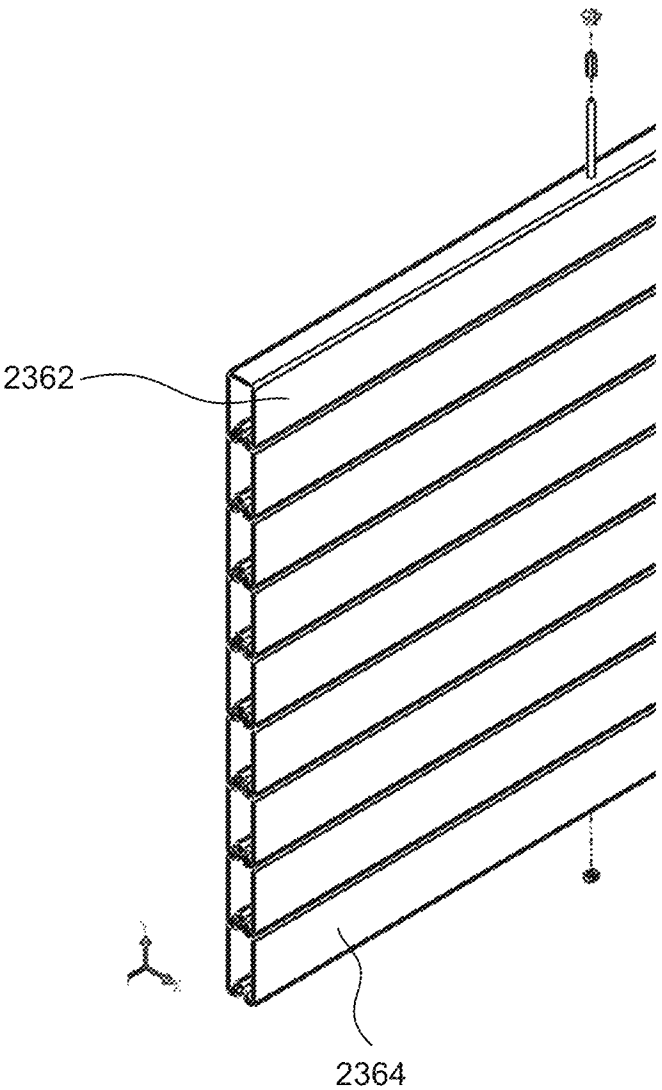
FIGS. 23A and 23B illustrate a partial side view of a series of elongate panels having a threaded rod for mechanically affixing the series of elongate panels to one another and a partial perspective view of the series of elongate panels, respectively.
Figure 23A:
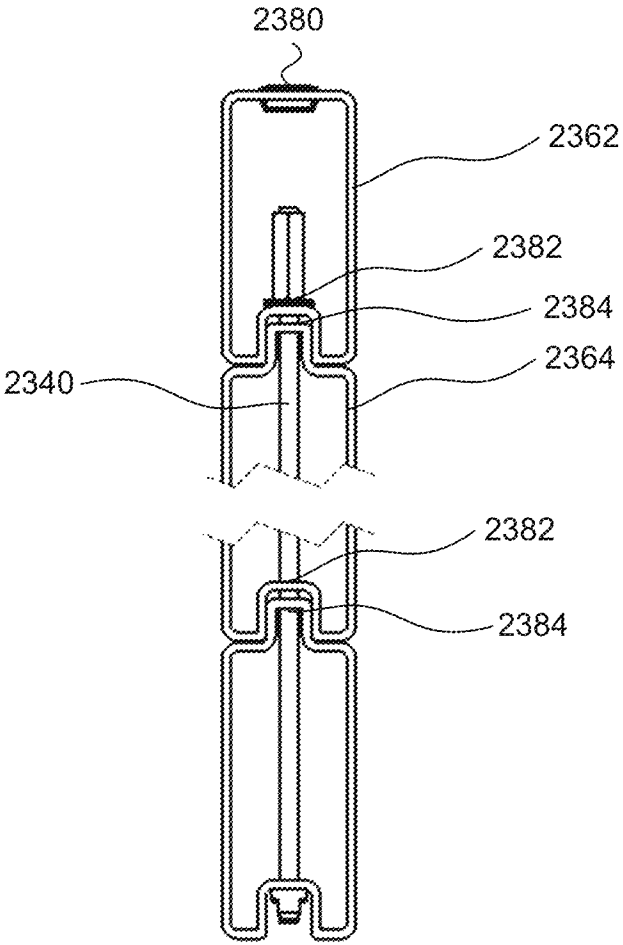

Reference is made to FIGS. 23A and 23B, which illustrate a partial side view of a series of elongate panels having a threaded rod for mechanically affixing the series of elongate panels to one another and a perspective view of the series of elongate panels, in accordance with embodiments of the present application.

In FIG. 23A, the series of elongate panels includes a plurality of intermediate panels 2364 and a top panel 2362 at an end of the series of elongate panels. The top panel 2362 includes a top aperture 2380 configured to receive a threaded rod 2340 there through.

Further, respective upstanding groove formations of the intermediate panels 2364 and the top panel 2362 may include a first through-hole aperture for receiving the threaded rod 2340. Further, the intermediate panels 2364 may include a second through-hole aperture within the respective upstanding tongue formations. When the series of elongate panels are stacked, adjacent first through-hole apertures aligned with second through-hole apertures may align and the threaded rod 2340 may be positioned through the aligned apertures for retaining the series of elongate panels in positional alignment. In some examples, the threaded rod 2340 may be a vertical support rod extending through the series of elongate panels at laterally spaced locations, similar to those described in U.S. Pat. No. 5,272,284.

FIG. 23B illustrates a partially exploded, perspective view of the series of elongate panels illustrated in FIG. 23A. The threaded rod 2340 may be inserted through the top aperture 2380 or via a through-hole aperture in an intermediate panel 2364 at an end of the series of elongate panels.

Figure 24:
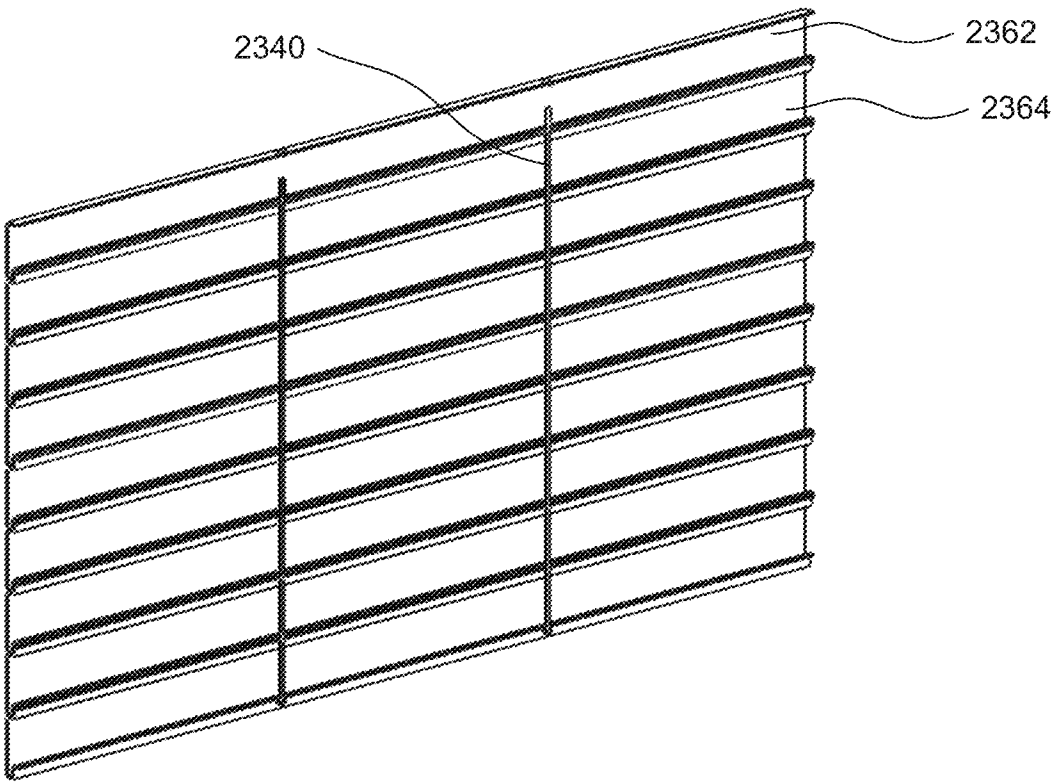
FIG. 24 illustrates a perspective, cutaway view of the series of elongate panels illustrated in FIG. 23.

FIG. 24 illustrates a perspective, cutaway view of the series of elongate panels illustrated in FIG. 23. FIG. 24 illustrates the threaded rod 2340 positioned in an affixed position to retain the series of elongate panels in positional alignment. For example, when the threaded rod 2340 is positioned in the affixing position, the series of elongate panels may be maintained in vertical and/or horizontal alignment relative to support posts (not illustrated in FIG. 24).

In some embodiments described in the present application, example support posts may be configured as H-beams or I-beams formed of steel or other structural material. Other shapes or configurations of support posts may be contemplated. For example, support posts may be in the form of a C-section or a T-section including a central member and a sole flange member extending along an edge of the central member. The sole flange member may be arranged to be substantially perpendicular to the central member. In some other embodiments, the support posts may include hollow sections resembling H-beams or I-beams and formed of plastic or other material.

As described in the present application, embodiments of sound walls may include a series of laterally spaced support posts and a plurality of substantially hollow elongate panels extending between adjacent support posts. The elongate panels may be a series in a stacked configuration.

One or more of the elongate panels in the series may include embodiments of stiffener members described in the present application. Features of the stiffener member in combination with features of the respective elongate panels may be configured to resist buckling of the elongate stiffener member, thereby reducing deflection of the series of elongate panels of the sound wall.

In some embodiments, when designing a sound wall, a threshold (or maximum) allowable elongate panel deflection measurement may be a design parameter. Determining (a) an optimal number of elongate stiffener members to be integrated into elongate panels and (b) spatial separation of reinforced elongate panels in the stacked configuration for a given threshold (or maximum) allowable elongate panel deflection measurement may be a function of: (i) the number of stacked elongate panels in the series for constructing the sound wall between adjacent support posts; and/or (ii) the length of the respective elongate panels (e.g., the approximate distance between a pair of adjacent support posts). A maximum allowable deflection of the elongate panels may be prescribed by regional regulatory bodies regulating building structures. That is, sound wall engineers may identify a given threshold allowable deflection of elongate panels in one geographical region (e.g., based on local regulatory requirements) that is different than another threshold allowable deflection of elongate panels in another geographical region (e.g., based on different local regulatory requirements).

In some scenarios, setting the above-described threshold allowable elongate panel deflection measurement may be dependent on a maximum expected wind load to be incident on the series of elongate panels. For example, a sound wall installed in an open coastal area that is adjacent a lake or ocean may normally experience a higher expected wind load to be incident on the series of panels than an expected wind load to be incident on another sound wall installed in an urban or heavily populated area. Accordingly, the sound wall installed in the open coastal area may be designed to with a more constrained panel deflection allowance than the sound wall installed in the heavily populated area.

Figure 25:
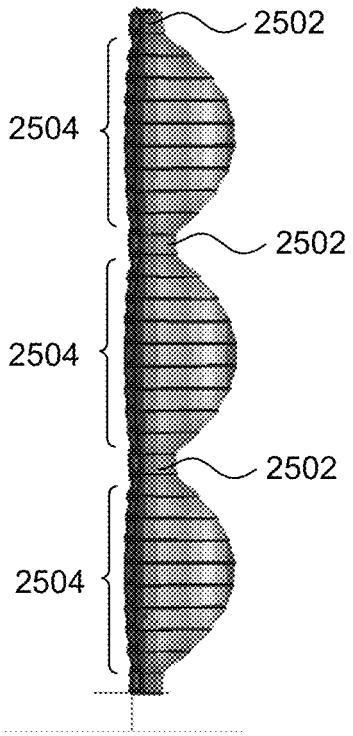
FIG. 25 illustrates a side view of a series of elongate panels subject to an example wind load.

Reference is made to FIG. 25, which illustrates a side view of a series of elongate panels of a sound wall being subject to a lateral wind load, in accordance with an embodiment of the present application. In the illustrated example, the series of elongate panels may include at least a reinforced elongate panel 2502 (e.g., stiffener member received within the elongate panel) and ten corresponding un-reinforced elongate panels (indicated by reference numeral 2504). In FIG. 25, the series of panels include a repeating pattern of one reinforced elongate panel 2502 followed by 9 un-reinforced elongate panels 2504). When the illustrated series of elongate panels are subjected to a lateral load, such as a wind load, the respective elongate panels can experience different mid-span deflection or displacement depending on the position of that respective elongate panel relative to a reinforced elongate panel 2502.

Based on the illustration in FIG. 25, it may be appreciated that when a greater number of elongate panels in the series are reinforced, the amount of mid-span deflection or displacement experienced by the series of elongate panels may be reduced. That is, by decreasing the ratio of un-reinforced elongate panels to reinforced elongate panels in a series of panels for embodiments of sound walls described in the present application, deflection or displacement of components of the sound wall due to external loads, such as wind loads, may be reduced.

By structurally enhancing selected elongate panels 124 using elongate stiffener members 190, horizontal (e.g., illustrated in FIG. 25) or vertical deflection of the stacked, elongated panels may be reduced or minimized. This allows the lateral distance between adjacent support posts 122 to be increased while avoiding sagging of the stacked, elongate panels.

Figure 26B:
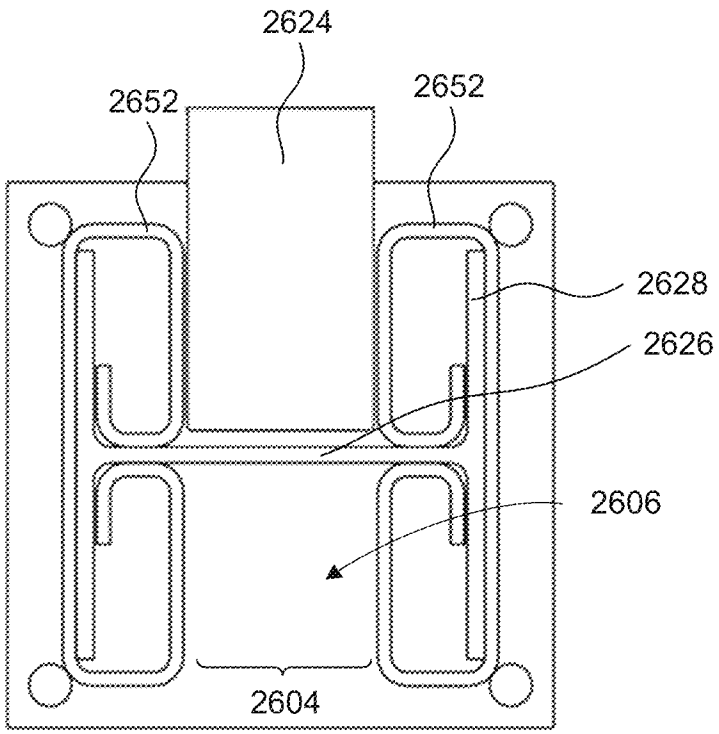
FIGS. 26A and 26B illustrate a partial perspective view of a support post and a top view of the support post retaining an end region of a panel, respectively.
Figure 26A:
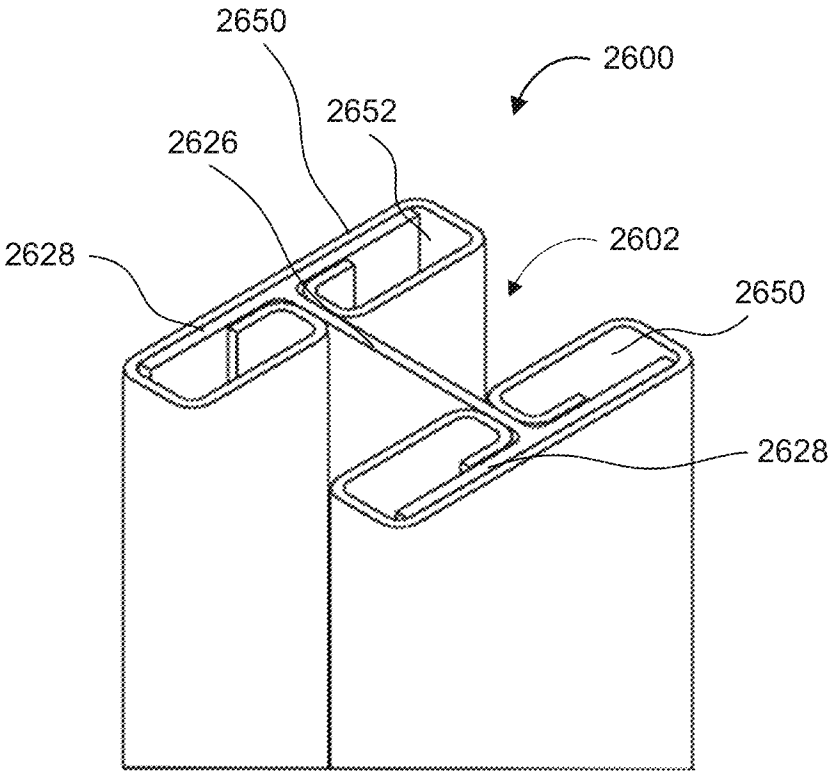

Reference is made to FIGS. 26A and 26B, which illustrate a partial perspective view of a support post 2600 and a top view of the support post 2600 retaining an end region of a panel 2624, respectively, in accordance with an embodiment of the present application.

The elongate post 2600 includes a pair of opposing flanges 2628 and a central member 2626 connecting the opposing flanges 2628. At least a portion of the respective opposing flanges 2628 and the central member 2626 may define a cavity 2602.

The cavity 2602 may be circumscribed by a portion of the pair of opposing flanges 2628 and the central member 2626. The cavity 2602 may have a cavity depth in a direction corresponding to the length of the central member 2626. That is, the cavity depth may be approximately the length of the central member 2626.

The elongate post 2600 may include a sleeve 2650 at least partially wrapping around one of the pair of opposing flanges 2628 to form a cavity structure 2652 extending towards the other of the pair of opposing flanges to provide a decreased cavity depth 2604. The length dimension of the decreased cavity depth 2604 may be less than the length dimension of the length of the central member 2626. Accordingly, as illustrated in FIG. 26B, a resultant cavity 2606 circumscribed by at least a cavity structure 2652, the central member 2626, and one of: (i) an opposing cavity structure 2652 or; (ii) an opposing flange 2628 of the support post 2600 is configured to retain end regions of elongate panels.

Although embodiments have been shown and described, those of skill in the art will appreciate that variations and modifications may be made without departing from the scope thereof as defined by the appended claims.

What is claimed is:

1. A stiffener member for a hollow elongate panel, the hollow elongate panel including a first end wall having a groove formation formed by a pair of inner walls and extending a length of the hollow elongate panel, the groove formation extending into the hollow elongate panel, the stiffener member comprising:

a bight member having opposing ends;

a pair of arm members respectively extending from one of the opposing ends of the bight member to provide a substantially U-shaped configuration; and a flange member extending from each of the pair of arm members, the flange member extending inwardly to abut one of the pair of inner walls of the groove formation when the stiffener member is received within the hollow elongate panel.

2. The stiffener member of claim 1, wherein the flange member extends substantially orthogonally from a distal end of the respective arm members to abut one of the pair of inner walls of the groove formation.

3. The stiffener member of claim 1, wherein the bight member, the pair of arm members, and the flange members are a unitary component.

4. The stiffener member of claim 1, wherein the respective arm members include one or more elongate slots aligned with one or more fastener slots of each of a front wall and a rear wall of the elongate panel.

5. The stiffener member of claim 1, wherein the pair of arm members are configured to respectively abut one of a front wall or a rear wall of the hollow elongate panel.

6. The stiffener member of claim 1, wherein the flange member is configured to abut a portion of the first end wall.

7. The stiffener member of claim 1, wherein the bight member is configured to abut a portion of a top wall of the elongate panel.

8. The stiffener member of claim 1, wherein the stiffener member extends substantially the length of the hollow elongate panel.

9. The stiffener member of claim 1, wherein the stiffener member is constructed with cold formed steel.

10. The stiffener member of claim 1, wherein an angle between the flange member and a corresponding arm member is an acute angle.

11. The stiffener member of claim 1, wherein an angle between the flange member and a corresponding arm member is an obtuse angle.

12. A stiffener member for a hollow elongate panel, the hollow elongate panel including a first end wall having a groove formation formed by a pair of inner walls and extending a length of the hollow elongate panel, the groove formation extending into the hollow elongate panel, the stiffener member comprising:

a substantially U-shaped member having a first end and a second end; and a flange member extending from at least one of the first end or the second end, the flange member extending inwardly to abut one of the pair of inner walls of the groove formation when the stiffener member is received within the hollow elongate panel.

13. The stiffener member of claim 12, wherein the flange member extends substantially orthogonally from the first end to abut one of the pair of inner walls of the groove formation.

14. The stiffener member of claim 12, wherein the flange member is configured to abut a portion of the first end wall.

15. A panel comprising:

a hollow elongate panel including:

a first end wall;

a first side wall and second side wall respectively extending from one of opposing sides of the first end wall; and a second end wall joining the first side wall and the second side wall, the second end wall including a groove formation extending into the hollow elongate panel and extending a length of the hollow elongate panel; and a stiffener member received within the hollow elongate panel, the stiffener member including:

a bight member having opposing ends;

a pair of arm members respectively extending from one of the opposing ends of the bight member to provide a substantially U-shaped configuration; and a flange member extending from each of the pair of arm members, the flange member extending inwardly to abut one of the pair of inner walls of the groove formation.

16. The panel of claim 15, wherein the flange member extends substantially orthogonally from a distal end of the respective arm members to abut one of the pair of inner walls of the groove formation.

17. The panel of claim 15, wherein the bight member, the pair of arm members, and the flange members are a unitary component.

18. The panel of claim 15, wherein the pair of arm members are configured to respectively abut one of the first side wall or the second side wall of the hollow elongate panel.

19. The panel of claim 15, wherein the flange member is configured to abut a portion of the first end wall.

20. The panel of claim 15, wherein the first end wall of the hollow elongate panel includes a tongue formation configured to be received within a groove formation of an adjacent panel, wherein the tongue formation extends away from the first end wall, wherein the groove formation extends into the hollow elongate panel, and wherein the bight member is a substantially planar member configured to abut a portion of the top wall.

21. The panel of claim 15, wherein the stiffener member extends substantially the length of the hollow elongate panel.

22. The panel of claim 15, wherein the stiffener member is constructed of cold formed steel.

23. The panel of claim 15, wherein the respective arm members include one or more elongate slots aligned with one or more fastener slots of each of the first side wall and the second side wall of the elongate panel.

24. The panel of claim 15, wherein the stiffener member extends substantially the length of the hollow elongate panel.

25. The panel of claim 15, wherein the stiffener member is constructed with cold formed steel.

* * * * *